US009696656B2

(12) United States Patent
Matsumoto et al.

(10) Patent No.: US 9,696,656 B2
(45) Date of Patent: Jul. 4, 2017

(54) DEVELOPER REPLENISHMENT DEVICE AND IMAGE FORMING APPARATUS

(71) Applicant: FUJI XEROX CO., LTD., Tokyo (JP)

(72) Inventors: Takuji Matsumoto, Kanagawa (JP); Yosuke Ninomiya, Kanagawa (JP); Kenichi Shimada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/817,720

(22) Filed: Aug. 4, 2015

(65) Prior Publication Data

US 2016/0282759 A1 Sep. 29, 2016

(30) Foreign Application Priority Data

Mar. 25, 2015 (JP) ..... 2015-063380

(51) Int. Cl.
*G03G 15/08* (2006.01)

(52) U.S. Cl.
CPC ..... *G03G 15/0879* (2013.01)

(58) Field of Classification Search
CPC ..... G03G 15/0867; G03G 15/104
See application file for complete search history.

(56) References Cited

U.S. PATENT DOCUMENTS 5,640,644 A * 6/1997 Kimura ..... G03G 15/0126 399/224
7,395,015 B2 7/2008 Ishiguro et al.
8,526,861 B2 9/2013 Matsumoto
2008/0118277 A1* 5/2008 Kurimoto ..... G03G 15/0877 399/261
2009/0110434 A1* 4/2009 Kusudo ..... G03G 15/0813 399/109
2014/0270859 A1* 9/2014 Hosokawa ..... G03G 15/0872 399/262

FOREIGN PATENT DOCUMENTS

JP 2006-267945 A 10/2006
JP 2007178806 A * 7/2007
JP 2010-117658 A 5/2010
JP 2012-203386 A 10/2012

OTHER PUBLICATIONS

JP_2007178806_A_T Tanda, Japan, Jul. 2007.*

* cited by examiner

*Primary Examiner* — Clayton E Laballe
*Assistant Examiner* — Victor Verbitsky
(74) *Attorney, Agent, or Firm* — Oliff PLC

(57) ABSTRACT

A developer replenishment device includes a developer transport member, a joint member, and an elastic member. The developer transport member transports a developer to a developing device. The joint member is attached to an end portion of the developer transport member on a side of the developing device so as to be relatively displaceable with respect to the developer transport member to be joined to the developing device so as to be able to replenish the developing device with the developer. The elastic member is interposed between the developer transport member and the joint member, and includes a guide hole that guides the developer from the developer transport member to the joint member.

10 Claims, 21 Drawing Sheets

DEVELOPER REPLENISHMENT DEVICE AND IMAGE FORMING APPARATUS

CROSS-REFERENCE TO RELATED APPLICATIONS

This application is based on and claims priority under 35 USC 119 from Japanese Patent Application No. 2015-063380 filed Mar. 25, 2015.

BACKGROUND

Technical Field

The present invention relates to a developer replenishment device and an image forming apparatus.

SUMMARY

According to an aspect of the present invention, there is provided a developer replenishment device including: a developer transport member that transports a developer to a developing device; a joint member attached to an end portion of the developer transport member on a side of the developing device so as to be relatively displaceable with respect to the developer transport member to be joined to the developing device so as to be able to replenish the developing device with the developer; and an elastic member interposed between the developer transport member and the joint member and including a guide hole that guides the developer from the developer transport member to the joint member.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below with reference to the drawings.

First Exemplary Embodiment

Figure 1:
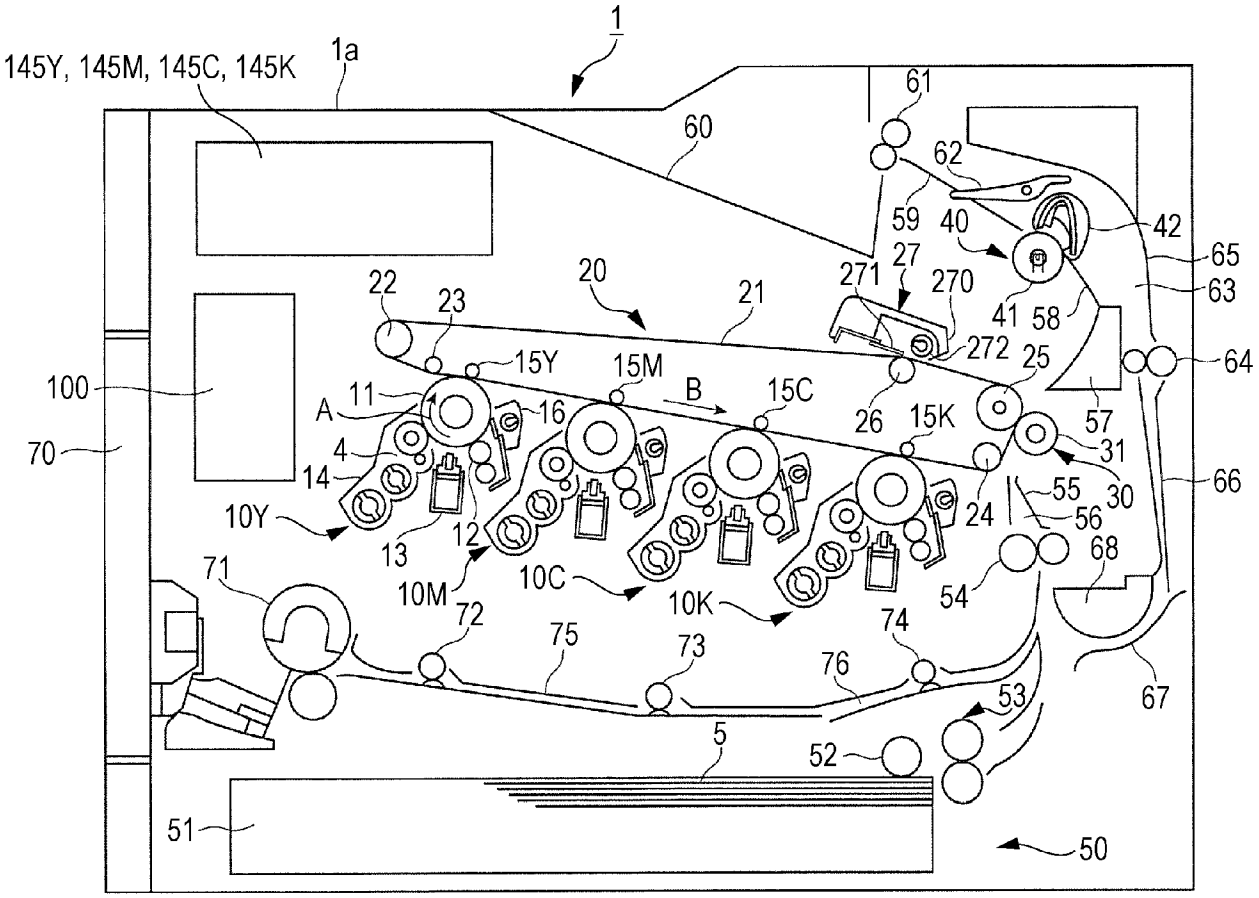
FIG. 1 illustrates the overall configuration of an image forming apparatus including a developer replenishment device according to a first exemplary embodiment of the present invention.
Figure 2:
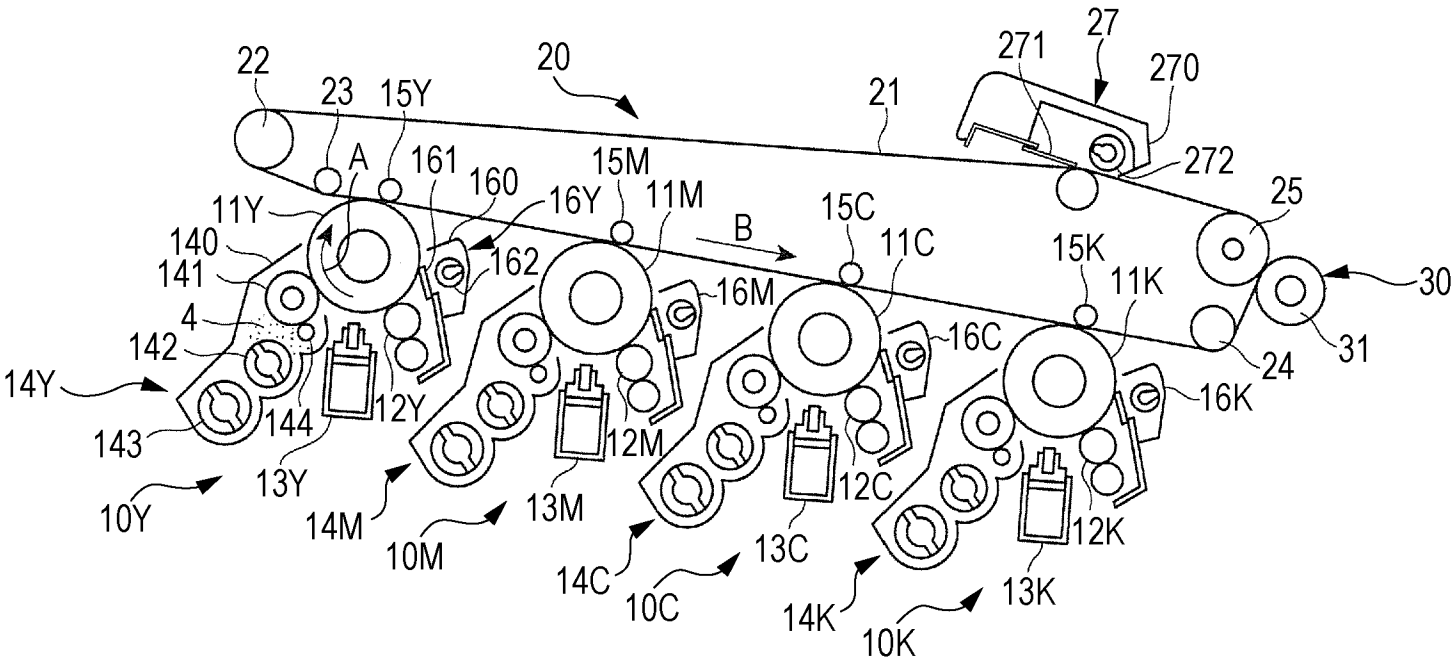
FIG. 2 illustrates the configuration of an image forming portion of the image forming apparatus according to the first exemplary embodiment of the present invention.

FIG. 1 illustrates an overview of the entire image forming apparatus including a developer replenishment device according to a first exemplary embodiment of the present invention. FIG. 2 illustrates a particular portion (such as an image preparing device) of the image forming apparatus as enlarged.

Overall Configuration of Image Forming Apparatus

An image forming apparatus 1 according to the first exemplary embodiment is configured as a color printer, for example. The image forming apparatus 1 includes plural image preparing devices 10, an intermediate transfer device 20, a paper feed device 50, a fixing device 40, and so forth. The image preparing devices 10 form a toner image to be developed using a toner that serves as a developer 4. The intermediate transfer device 20 holds the toner images formed by the image preparing devices 10 to transport the toner images finally to a second transfer position at which the toner images are subjected to a second transfer performed onto recording paper 5 that serves as an example of a recording medium. The paper feed device 50 stores and transports the prescribed recording paper 5 to be supplied to the second transfer position of the intermediate transfer device 20. The fixing device 40 fixes the toner images on the recording paper 5 which have been subjected to the second transfer performed by the intermediate transfer device 20. In the drawing, reference symbol 1*a* denotes a body of the image forming apparatus. The body 1*a* is formed from a support structure member, an outer covering, and so forth.

The image preparing devices 10 are composed of four image preparing devices 10Y, 10M, 10C, and 10K that exclusively form toner images in four colors, namely yellow (Y), magenta (M), cyan (C), and black (K), respectively. The four image preparing devices 10 (Y, M, C, K) are disposed side by side in line as inclined in the internal space of the body 1*a*.

As illustrated in FIGS. 1 and 2, the image preparing devices 10 (Y, M, C, K) each include a rotatable photosensitive drum 11 that serves as an example of an image holding element. The following devices that serve as an example of a toner image forming unit are principally disposed around the photosensitive drum 11. The devices include a charging device 12, an exposure device 13, a developing device 14 (Y, M, C, K), a first transfer device 15 (Y, M, C, K), a drum cleaning device 16 (Y, M, C, K), and so forth. The charging device 12 charges a peripheral surface (image holding surface) of the photosensitive drum 11, on which an image may be formed, with a prescribed potential. The exposure device 13 radiates light based on information (signal) on an image to the charged peripheral surface of the photosensitive drum 11 to form an electrostatic latent image (in each color) with a potential difference. The developing device 14 (Y, M, C, K) develops the electrostatic latent image using a toner of the developer 4 for the corresponding color (Y, M, C, K) to form a toner image. The first transfer device 15 (Y, M, C, K) serves as an example of a first transfer unit that transfers the toner image to the intermediate transfer device 20. The drum cleaning device 16 (Y, M, C, K) removes attached matter such as a toner remaining on and adhering to the image holding surface of the photosensitive drum 11 after being subjected to the first transfer to clean the photosensitive drum 11.

The photosensitive drum 11 has an image holding surface formed by providing a photoconductive layer (photosensitive layer) made of a photosensitive material on the peripheral surface of a grounded cylindrical or columnar base material. The photosensitive drum 11 is supported so as to receive power from a rotary drive device (not illustrated) to rotate in the direction indicated by the arrow A.

The charging device 12 is configured as a contact charging roller disposed in contact with the photosensitive drum 11. A charging voltage is supplied to the charging device 12. In the case where the developing device 14 performs reversal development, a voltage or a current having the same polarity as the polarity for charging the toner supplied from the developing device 14 is supplied as the charging voltage. A non-contact charging device such as a scorotron disposed without contact with the surface of the photosensitive drum 11 may be used as the charging device 12.

The exposure device 13 radiates the light, formed in accordance with the information on the image input to the image forming apparatus 1, toward the peripheral surface of the photosensitive drum 11 after being charged to form an electrostatic latent image. When a latent image is to be formed, information (signal) on the image input in any manner to the image forming apparatus 1 is transmitted to the exposure device 13.

The exposure device 13 is constituted of a light emitting diode (LED) print head that radiates light matching the image information to the photoconductor drum 11 using plural LEDs that serve as light emitting elements arranged along the axial direction of the photoconductor drum 11 to form an electrostatic latent image. In the exposure device 13, deflection scanning may be performed along the axial direction of the photoconductor drum 11 using laser light configured in accordance with the image information.

Figure 3:
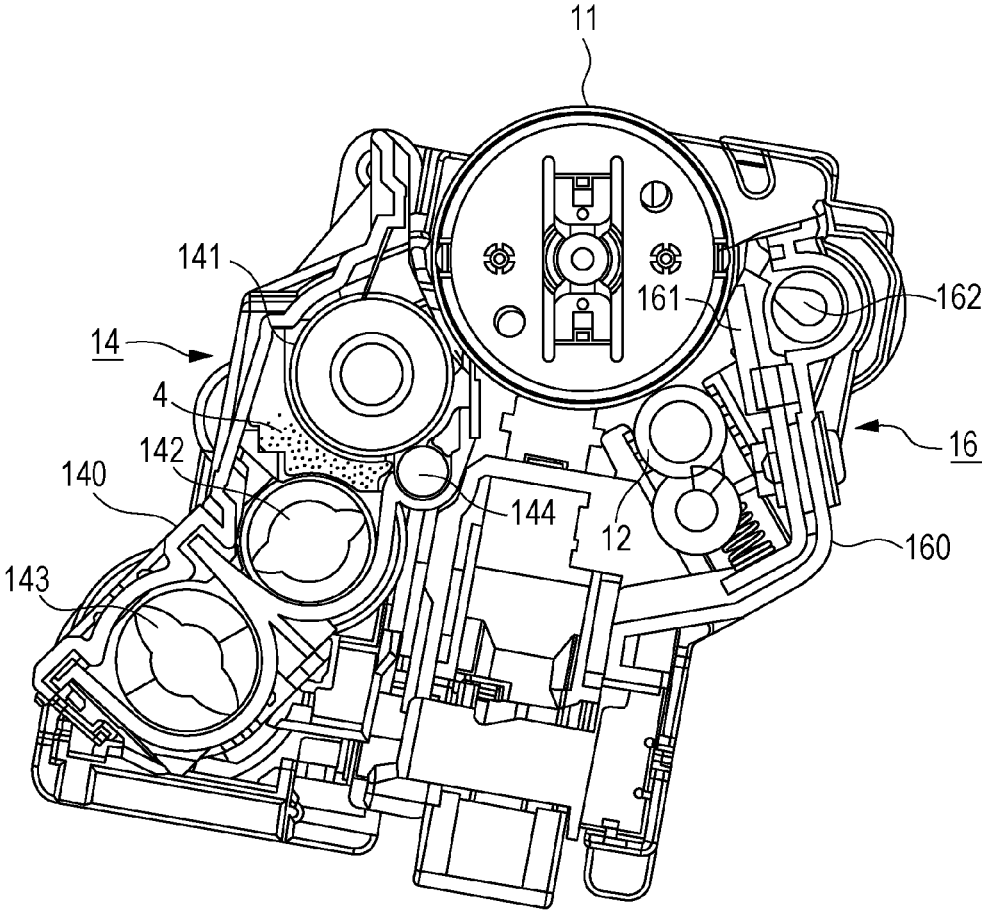
FIG. 3 is a sectional view illustrating the configuration of a process cartridge.

As illustrated in FIGS. 2 and 3, the developing devices 14 (Y, M, C, K) each include a housing 140, a developing roller 141, first and second agitation/transport members 142 and 143, a layer thickness restricting member 144, and so forth. The housing 140 includes an opening portion and a storing chamber for the developer 4, and houses the other components. The developing roller 141 holds the developer 4, and transports the developer 4 to a development region facing the photosensitive drum 11. The first and second agitation/transport members 142 and 143, which may be two screw augers, transport the developer 4 to cause the developer 4 to pass through the developing roller 141 while agitating the developer 4. The layer thickness restricting member 144 restricts the amount (layer thickness) of the developer held by the developing roller 141. A development voltage supplied from a power source device (not illustrated) is applied between the developing roller 141 of the developing device 14 and the photosensitive drum 11. In addition, power from a rotary drive device (not illustrated) is transmitted to the developing roller 141 and the agitation/transport members 142 and 143 to rotate the developing roller 141 and the agitation/transport members 142 and 143 in a prescribed direction. Further, a two-part developer containing a non-magnetic toner and a magnetic carrier is used as the developers 4 (Y, M, C, K) for the four colors. A developer replenishment device to be discussed later replenishes the developing device 14 with the developer containing at least a toner at a prescribed timing. A one-component developer containing only a toner may be used as the developers 4 (Y, M, C, K) for the four colors.

The first transfer device 15 (Y, M, C, K) is a contact transfer device including a first transfer roller that rotates in contact with the periphery of the photosensitive drum 11 via an intermediate transfer belt 21 and that is supplied with a first transfer voltage. A DC voltage having a polarity opposite to the polarity for charging the toner is supplied from a power source device (not illustrated) as the first transfer voltage.

As illustrated in FIGS. 2 and 3, the drum cleaning device 16 includes a body 160, a cleaning plate 161, a feeding member 162, and so forth. The body 160 has the shape of a partially open container that covers a region extending to a location below the charging device 12. The cleaning plate 161 is disposed so as to contact the peripheral surface of the photosensitive drum 11, after being subjected to the first transfer, with a prescribed pressure to clean the photosensitive drum 11 by removing attached matter such as a residual toner. The feeding member 162, which may be a screw auger, recovers attached matter, such as a toner, removed by the cleaning plate 161 to feed the attached matter to a recovery system (not illustrated). A plate-like member (for example, blade) made of a material such as rubber is used as the cleaning plate 161.

As illustrated in FIGS. 1 and 2, the intermediate transfer device 20 is disposed at a position above the image preparing devices 10 (Y, M, C, K). The intermediate transfer device 20 is principally composed of the intermediate transfer belt 21, plural belt support rollers 22 to 26, a second transfer device 30, and a belt cleaning device 27. The intermediate transfer belt 21 rotates in the direction indicated by the arrow B while passing through first transfer positions between the photosensitive drums 11 and the first transfer devices 15 (first transfer rollers). The belt support rollers 22 to 26 rotatably support the intermediate transfer belt 21 by holding the intermediate transfer belt 21 in a desired state from the inner side. The second transfer device 30 serves as an example of a second transfer member disposed on the side of the outer peripheral surface (image holding surface) of the intermediate transfer belt 21 supported by the belt support roller 25 to transfer the toner image on the intermediate transfer belt 21 to the recording paper 5 through a second transfer. The belt cleaning device 27 cleans the intermediate transfer belt 21 by removing attached matter such as a toner and paper powder remaining on and adhering to the outer peripheral surface of the intermediate transfer belt 21 after passing through the second transfer device 30.

An endless belt fabricated from a material obtained by dispersing a resistance adjusting agent such as carbon black etc. in a synthetic resin such as a polyimide resin or a polyamide resin, for example, is used as the intermediate transfer belt 21. The belt support roller 22 is configured as a driving roller rotationally driven by a drive device (not illustrated). The belt support roller 23 is configured as a driven roller that maintains the travel position etc. of the intermediate transfer belt 21. The belt support roller 24 is configured as a tension applying roller that applies tension to the intermediate transfer belt 21. The belt support roller 25 is configured as a second transfer back-up roller. The belt support roller 26 is configured as a support roller that supports the back surface of the intermediate transfer belt 21 cleaned by the belt cleaning device 27.

As illustrated in FIG. 1, the second transfer device 30 is a contact transfer device including a second transfer roller 31 provided at the second transfer position, which is a portion of the outer peripheral surface of the intermediate transfer belt 21 supported by the belt support roller 25 in the intermediate transfer device 20. The second transfer roller 31 rotates in contact with the peripheral surface of the intermediate transfer belt 21, and is supplied with a second transfer voltage. A DC voltage having a polarity opposite to or the same as the polarity for charging the toner is supplied as the second transfer voltage to the second transfer device 31 or the support roller 25 of the intermediate transfer device 20.

As illustrated in FIG. 2, the belt cleaning device 27 is configured similarly to the drum cleaning device 16, and includes a body 270, a cleaning plate 271, a feeding member 272, and so forth. The body 270 has the shape of a partially open container. The cleaning plate 271 is disposed so as to contact the peripheral surface of the intermediate transfer belt 21, after being subjected to the second transfer, with a prescribed pressure to clean the intermediate transfer belt 21 by removing attached matter such as a residual toner. The feeding member 272, which may be a screw auger, recovers attached matter, such as a toner, removed by the cleaning plate 271 to feed the attached matter to a recovery system (not illustrated). A plate-like member (for example, blade) made of a material such as rubber is used as the cleaning plate 271.

The fixing device 40 is composed of a heating rotary member 41, a pressurizing rotary member 42, and so forth. The heating rotary member 41, which may be in the form of a drum or a belt, is heated by a heating unit such that the surface temperature is maintained at a prescribed temperature. The pressurizing rotary member 42, which may be in the form of a drum or a belt, rotates in contact with the heating rotary member 41 at a predetermined pressure in the state of being substantially parallel to the axial direction of the heating rotary member 41. In the fixing device 40, a contact portion at which the heating rotary member 41 and the pressurizing rotary member 42 contact each other serves as a fixation processing portion at which a prescribed fixation process (heating and pressurization) is performed.

The paper feed device 50 is disposed at a position below the image preparing devices 10 (Y, M, C, K) for yellow (Y), magenta (M), cyan (C), and black (K). The paper feed device 50 is principally composed of one or more paper storing members 51 and feeding devices 52 and 53. The paper storing members 51 store a stack of sheets of the recording paper 5 of desired size, type, etc. The feeding devices 52 and 53 feed the recording paper 5, one sheet at a time, from the paper storing members 51. The paper storing members 51 are attached so as to be drawn out toward the front surface (a side surface that the user faces during operation) of the body 1*a*, that is, toward the left side surface in the illustrated example, for example.

Examples of the recording paper 5 include regular paper and overhead projector (OHP) sheets for use for electrophotographic copiers and printers. In order to further improve the smoothness of the surface of an image after being fixed, the surface of the recording paper 5 is preferably as smooth as possible. For example, coated paper prepared by coating the surface of regular paper with a resin or the like, so-called cardboard with a relatively large basis weight such as art paper for printing, and so forth may also be used.

A paper feed/transport path 56 is provided between the paper feed device 50 and the second transfer device 30. The paper feed/transport path 56 is composed of one or more pairs of paper transport rollers 54, a transport guide 55, and so forth. The pair of paper transport rollers 54 transport the recording paper 5 fed from the paper feed device 50 to the second transfer position. The pair of paper transport rollers 54 are configured as rollers (resist rollers) that adjust the timing to transport the recording paper 5, for example. Transport guides 57 and 58 etc. are provided between the second transfer device 30 and the fixing device 40. The transport guides 57 and 58 transport the recording paper 5 after being subjected to the second transfer fed from the second transfer roller 31 of the second transfer device 30 to the fixing device 40. Further, a pair of paper ejection rollers 61 are disposed near a paper ejection port of the image forming apparatus body 1*a*. The pair of paper ejection rollers 61 eject the recording paper 5 after being fixed fed from the fixing device 40 to a paper ejection portion 60 provided at the upper portion of the body 1*a* along a transport guide 59.

A switching gate 62 that switches the paper transport path is provided between the fixing device 40 and the pair of paper ejection rollers 61. The rotational direction of the pair of paper ejection rollers 61 is switchable between the forward direction (ejection direction) and the reverse direction. In the case where an image is to be formed on both surfaces of the recording paper 5, the rotational direction of the pair of paper ejection rollers 61 is switched from the forward direction (ejection direction) to the reverse direction after the rear end of the recording paper 5 on one surface of which an image has been formed passes through the switching gate 62. The transport path of the recording paper 5 which is transported in the reverse direction by the pair of paper ejection rollers 61 is switched by the switching gate 62 such that the recording paper 5 is transported to a two-sided printing transport path 63 formed along substantially the vertical direction. The two-sided printing transport path 63 includes a pair of paper transport rollers 64, transport guides 65 to 68, and so forth. The pair of paper transport rollers 64 transport the recording paper 5 to the pair of paper transport rollers 54 with the front and back sides of the recording paper 5 reversed.

In FIG. 1, reference numeral 70 denotes a manual feed tray provided on the front surface (in the drawing, left side surface) of the image forming apparatus body 1*a* so as to be openable and closable. A feeding device 71 and a manual feed paper transport path 76 are provided between the manual feed tray 70 and the pair of paper transport rollers 54. The feeding device 71 feeds the recording paper 5 housed in the manual feed tray 70, one sheet at a time. The manual feed paper transport path 76 is composed of plural pairs of paper transport rollers 72 to 74, a transport guide 75, and so forth.

In FIG. 1, reference numeral 145 (Y, M, C, K) denotes each of plural toner cartridges that serve as an example of developer storing containers that are arranged along a direction orthogonal to the sheet surface and that store a developer containing at least a toner to be supplied to the corresponding developing devices 14 (Y, M, C, K).

In FIG. 1, in addition, reference numeral 100 denotes a control device that comprehensively controls operation of the image forming apparatus 1. The control device 100 includes a central processing unit (CPU), a read only memory (ROM), a random access memory (RAM), a bus that connects between the CPU, the ROM, etc., a communication interface, and so forth (not illustrated).

Configuration of Process Cartridge

In the exemplary embodiment, image forming members such as the photoconductor drum 11 and the charging device 12, the developing device 14, and the drum cleaning device 16 disposed around the photoconductor drum 11 are integrally unitized and assembled to each other to compose a process cartridge 80 that serves as an example of an image forming unit. The exposure device 13 is independently unitized separately from the process cartridge 80.

Figure 4:
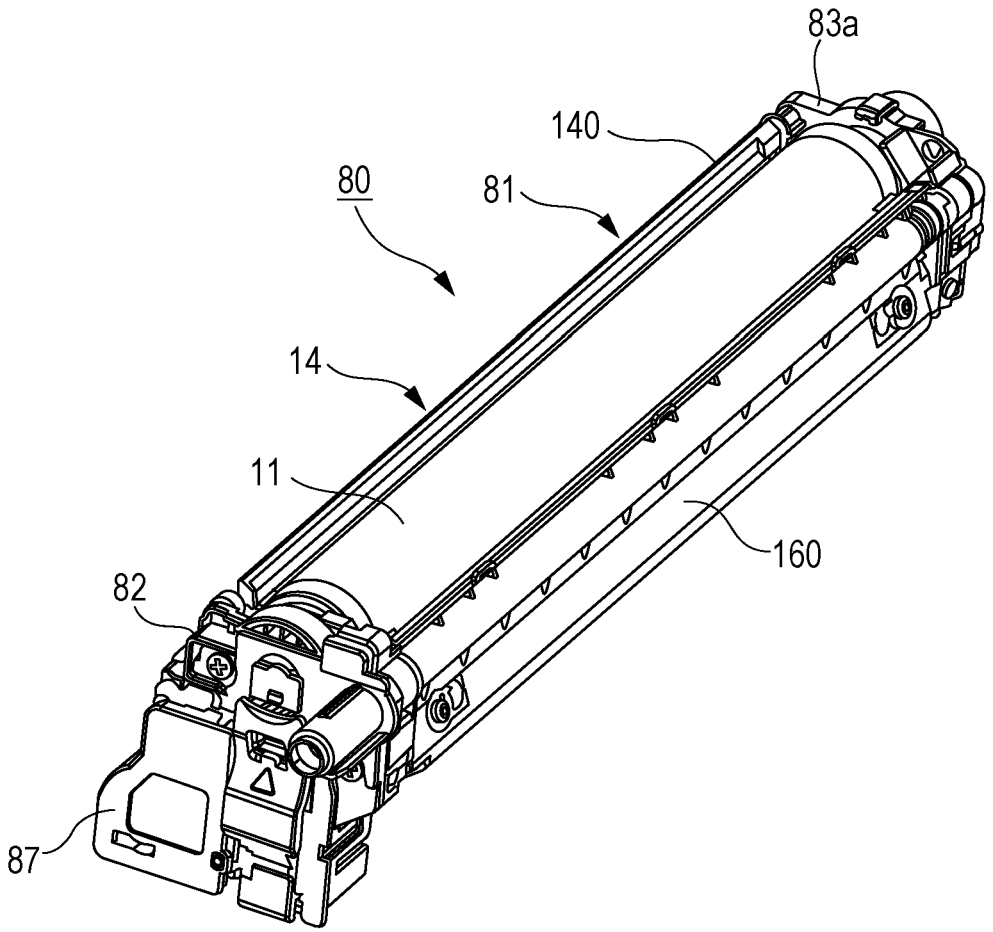
FIG. 4 is a perspective view illustrating the configuration of the process cartridge.
Figure 5:
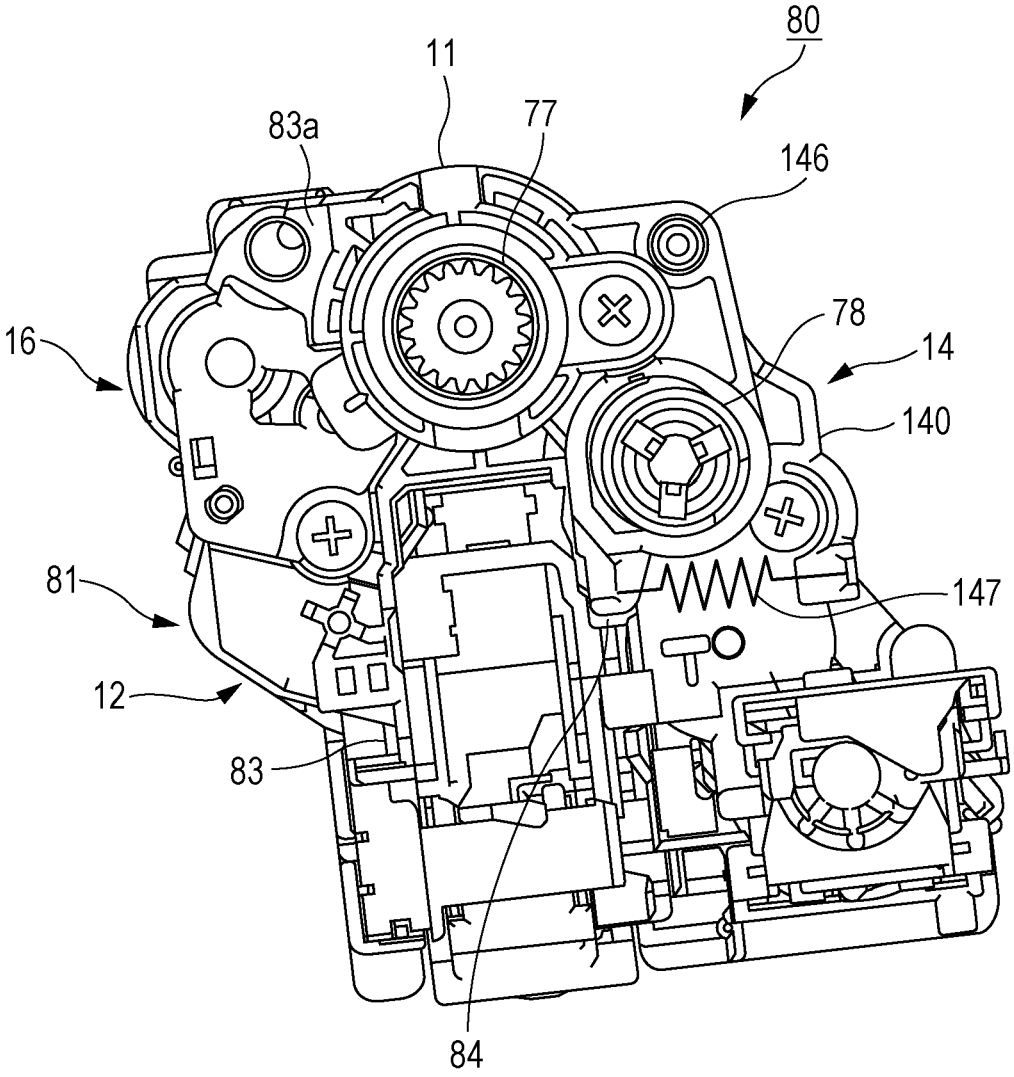
FIG. 5 is a back view illustrating the process cartridge.
Figure 6:
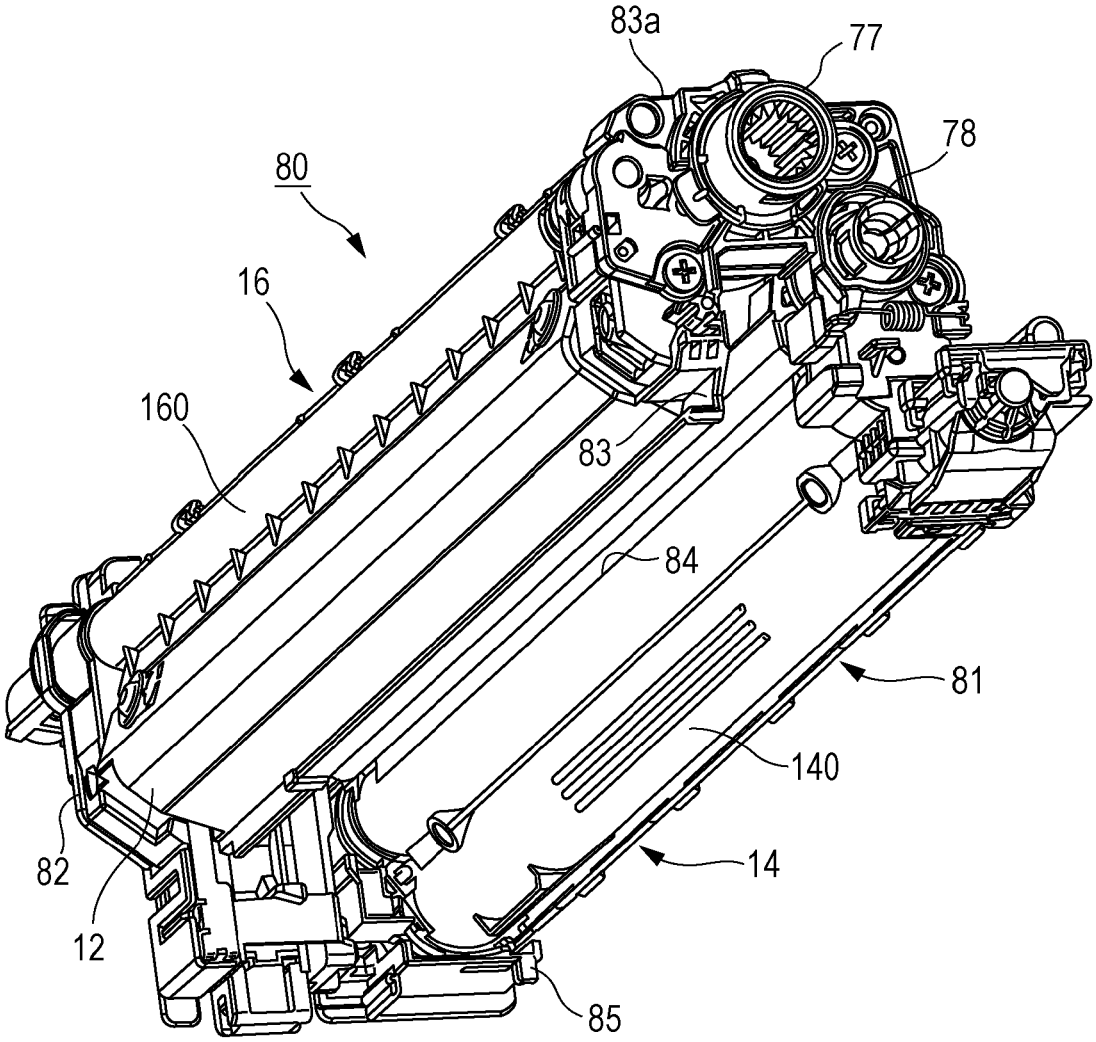
FIG. 6 is a perspective view illustrating the configuration of the process cartridge.

FIG. 4 is a perspective view illustrating the appearance of the process cartridge 80 as seen from obliquely above on the front side along the mount direction. FIG. 5 is a side view of the process cartridge 80 as seen from the distal end side (back side) along the mount direction. FIG. 6 is a perspective view illustrating the appearance of the process cartridge 80 as seen from obliquely below on the back side along the mount direction.

As illustrated in FIGS. 4 to 6, the process cartridge 80 includes a process cartridge body 81 that serves as an example of an image forming unit body to which the photoconductor drum 11, the charging device 12, the developing device 14, and the drum cleaning device 16 which have been integrally unitized are mounted. In the illustrated exemplary embodiment, the process cartridge body 81 is composed of the housing 140 of the developing device 14, a body 160 of the drum cleaning device 16, frame members 82 and 83*a* disposed at end portions on the front and back sides, respectively, along the mount direction, and so forth.

The photoconductor drum 11 is rotatably mounted to the frame members 82 and 83*a* of the process cartridge body 81. As illustrated in FIG. 5, meanwhile, the developing device 14 is attached so as to be swingable with respect to the process cartridge body 81 about a swing fulcrum 146 in such a direction that the developing roller 141 is brought into and out of contact with the photoconductor drum 11. In addition, the developing device 14 is configured such that tracking rollers (not illustrated) that serve as gap setting members disposed at both end portions of the developing roller 141 along the axial direction are caused to abut against the surface of the photoconductor drum 11 by an elastic member 147. The elastic member 147, which may be a coil spring, is provided to extend between the housing 140 of the developing device 14 and the frame members 82 and 83*a* of the process cartridge body 81 to which the photoconductor drum 11 is rotatably mounted. As illustrated in FIGS. 5 and 6, a first drive force transmission portion 77 and a second drive force transmission portion 78 are provided to project from an end surface of the process cartridge 80 on the distal end side along the mount direction. The first drive force transmission portion 77 transmits a drive force to the photoconductor drum 11. The second drive force transmission portion 78 transmits a drive force to the developing roller 141.

Figure 7:
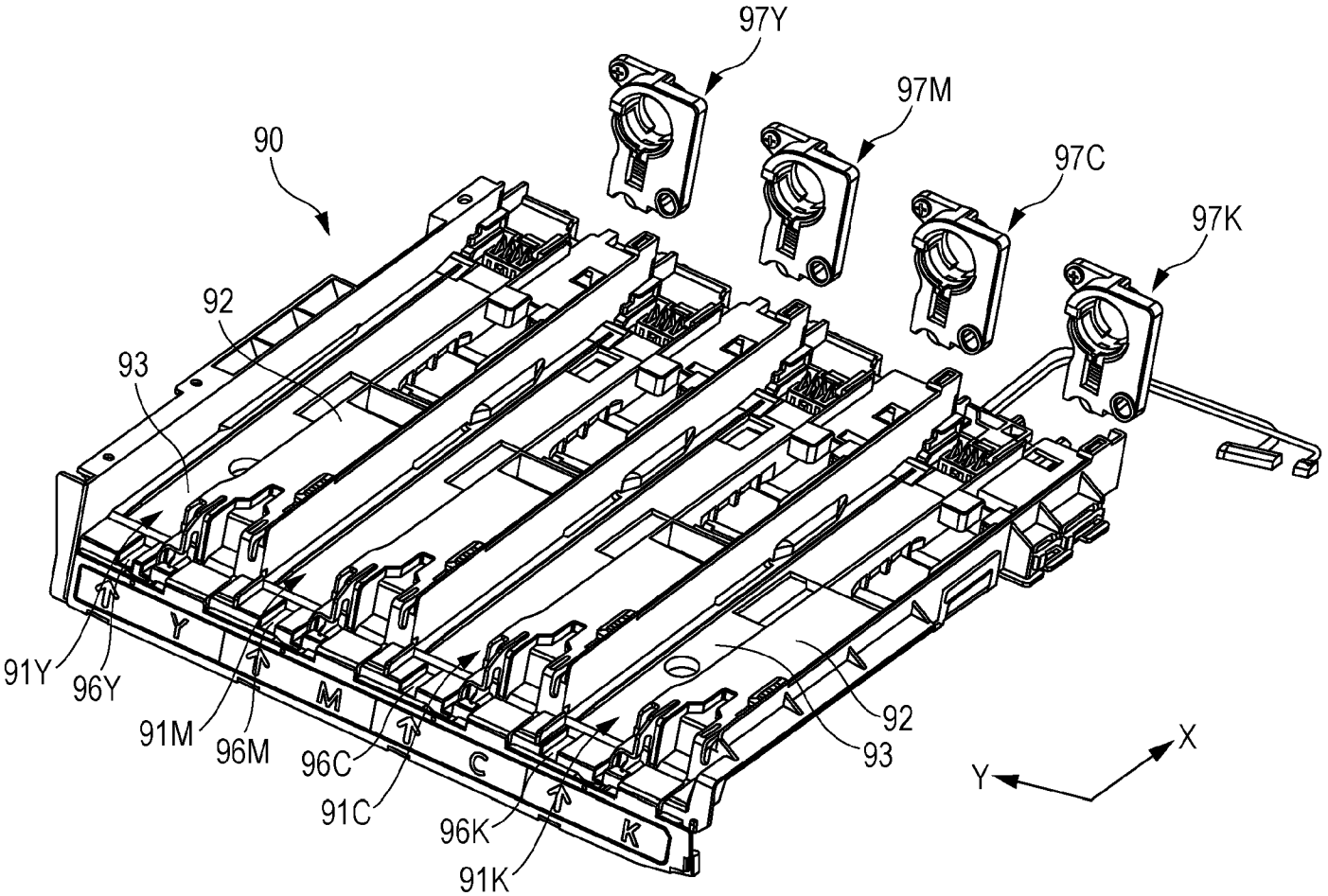
FIG. 7 is a perspective view illustrating the configuration of a mount portion for process cartridges.
Figure 8:
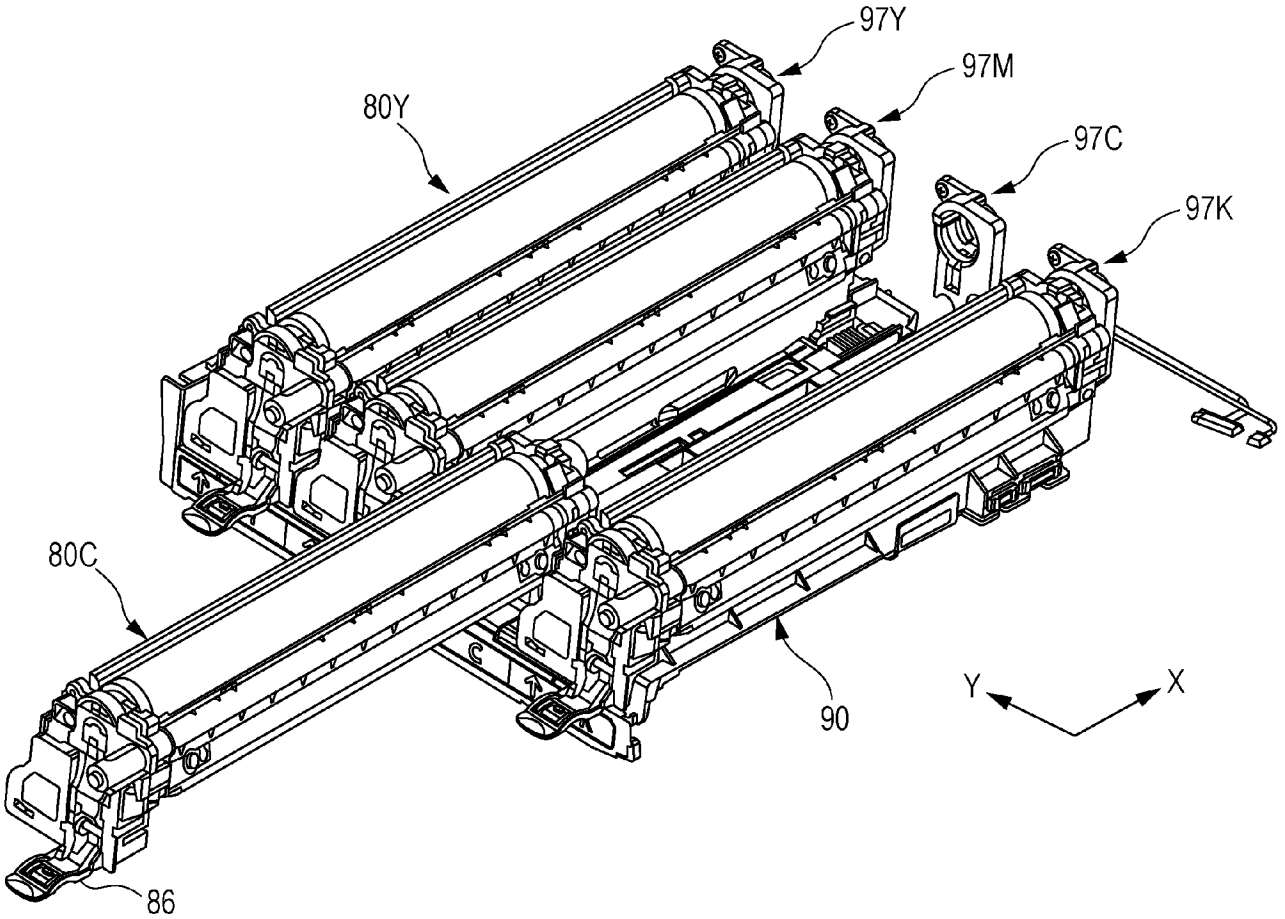
FIG. 8 is a perspective view illustrating the configuration of the mount portion for the process cartridges.

As illustrated in FIGS. 7 and 8, the process cartridge 80 is removably mounted to a unit mount portion 90, which is provided to the image forming apparatus body 1*a*, along the axial direction of the photoconductor drum 11.

The unit mount portion 90 is disposed above the manual feed paper transport path 76 inside the image forming apparatus body 1*a*. The unit mount portion 90 includes four cartridge support portions 91 (Y, M, C, K) that correspond to the process cartridges 80 (Y, M, C, K) for yellow (Y), magenta (M), cyan (C), and black (K) and that extend along the left-right direction with respect to the front surface of the image forming apparatus body 1*a*. As illustrated in FIG. 1, the image preparing devices 10 (Y, M, C, K) which are composed of the process cartridges 80 (Y, M, C, K) are disposed as inclined such that the yellow (Y) side is relatively high and the black (K) side is relatively low. Therefore, as with the image preparing devices 10 (Y, M, C, K), the four cartridge support portions 91 (Y, M, C, K) are disposed as inclined such that the side of the cartridge support portion 91Y for yellow (Y) is relatively high and the side of the cartridge support portion 91K for black (K) is relatively low.

The four cartridge support portions 91 (Y, M, C, K) are basically configured in the same manner as each other. As illustrated in FIG. 7, the cartridge support portion 91 includes a mount platform 92 and a guide surface 93. The mount platform 92 is formed in the shape of a platform that is one level higher to allow mounting of the exposure device 13 which is unitized separately from the process cartridge 80. The guide surface 93 is provided in a recessed shape adjacently at a side of the mount platform 92 along a direction (Y direction) that crosses the mount direction (X direction) of the process cartridge 80, and guides the bottom surface, which corresponds to the developing device 14, of the process cartridge 80 to be removably mounted.

Figure 9:
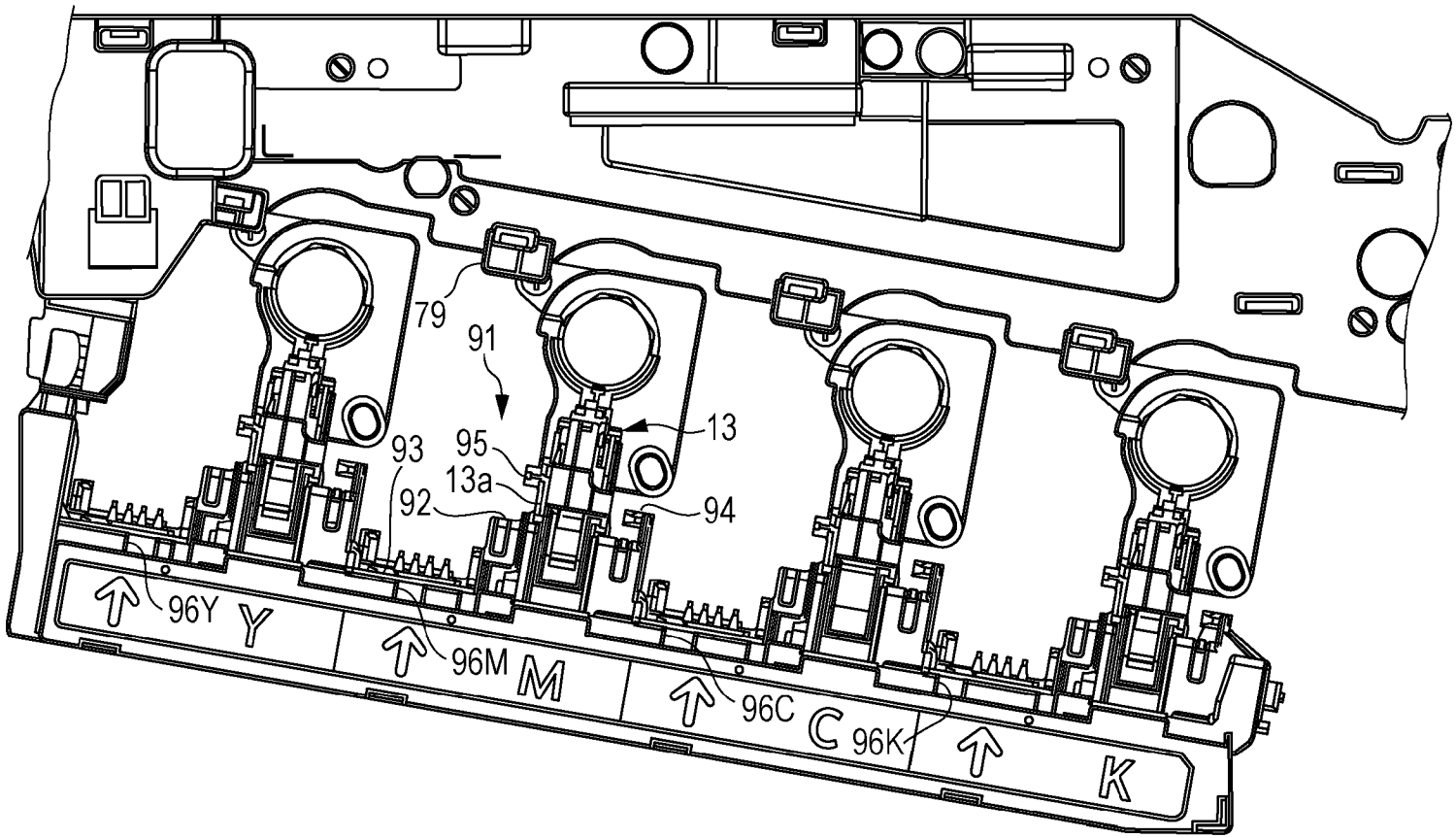
FIG. 9 is a front view illustrating the mount portion for the process cartridges.

As illustrated in FIG. 9, in addition, the cartridge support portion 91 includes a first guide portion 94 and a second guide portion 95. The first guide portion 94 is provided at one end portion of the mount platform 92 along the direction (Y direction) that crosses the mount direction (X direction) of the process cartridge 80 to project upward in an inverted L shape. The second guide portion 95 is a projected portion that projects from a side surface of a housing 13*a* of the unitized exposure device 13 mounted to the mount platform 92.

When the process cartridge 80 is mounted to the cartridge support portion 91, the first guide portion 94 of the cartridge support portion 91 is inserted into a recessed portion 83 provided at the lower portion of the charging device 12 of the process cartridge 80 as illustrated in FIGS. 5 and 6, and the second guide portion 95 is inserted into a recessed portion 84 provided in the inner side surface of the developing device 14 of the process cartridge 80, thereby guiding the process cartridge 80. Meanwhile, the guide surface 93 of the cartridge support portion 91 houses the lower end portion of the developing device 14 to guide the process cartridge 80.

As illustrated in FIGS. 7 and 9, in addition, a recessed portion 96 is provided at an end portion of the cartridge support portion 91 on the front side along the mount direction (X direction) of the process cartridge 80. The recessed portion 96 has a non-compatible shape to enable only the process cartridge 80 for the corresponding color to be mounted to the cartridge support portion 91 in order to prevent the process cartridge 80 from being mounted to a wrong cartridge support portion 91. The recessed portion 96 in a non-compatible shape is different in position along the direction (Y direction) that crosses the mount direction (X direction) for each of the process cartridges 80 (Y, M, C, K) for yellow (Y), magenta (M), cyan (C), and black (K). As illustrated in FIG. 6, meanwhile, a projected portion 85 is provided on the bottom surface of the frame member 82 provided at an end portion of the process cartridge on the front side along the mount direction. The projected portion 85 has a non-compatible shape to be mountable to only the recessed portion 96 of the cartridge support portion for the corresponding color.

Figure 10:
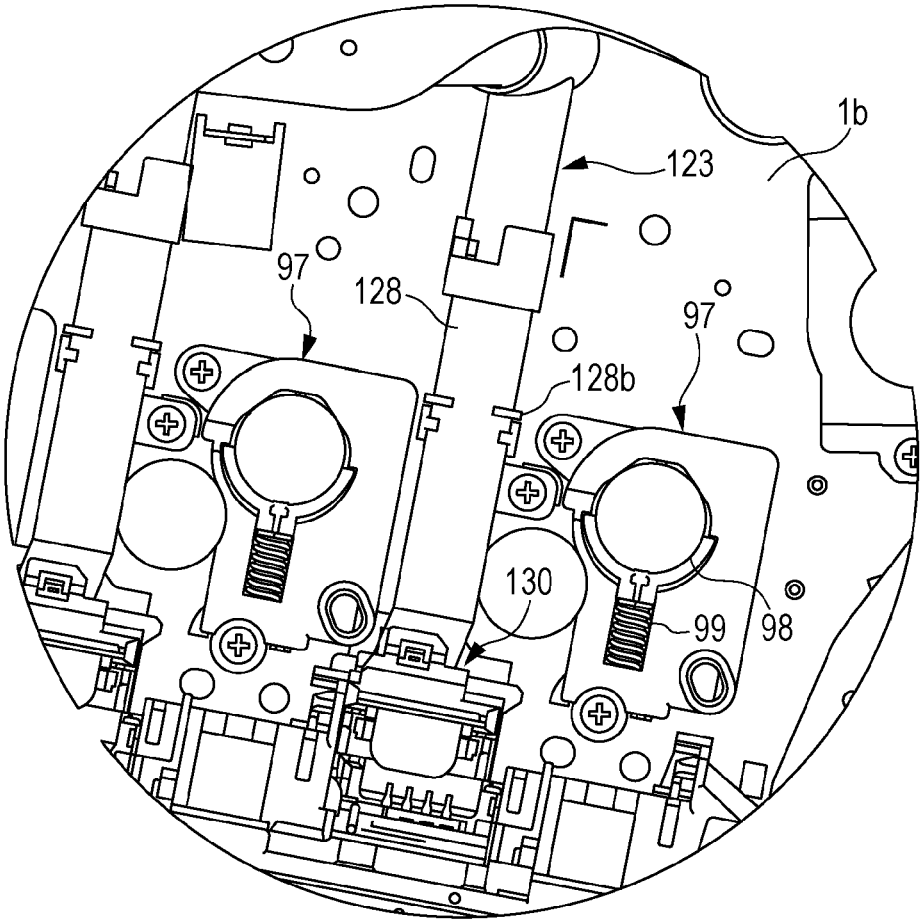
FIG. 10 is a front view illustrating a particular portion of the mount portion for the process cartridges.

As illustrated in FIG. 7, the image forming apparatus body 1*a* includes a positioning member 97 provided at an end portion on the back side along the mount direction (X direction) of the process cartridge 80 to relatively engage with the first drive force transmission portion 77 of the photoconductor drum 11 provided to the process cartridge 80 to move an end portion of the process cartridge 80 on the distal end side to a working position set on the upper side for positioning. That is, the positioning member 97 of the image forming apparatus body 1*a* positions the first drive force transmission portion 77 of the process cartridge 80 at an operating position set to be higher than the first drive force transmission portion 77 of the process cartridge 80 mounted to the image forming apparatus body 1*a*. As illustrated in FIG. 10, the positioning member 97 includes a support member 98 and an elastic member 99 provided on the lower side at an end portion on the front side along the mount direction (X direction) of the process cartridge 80. The support member 98 has a semicircular shape, and supports the first drive force transmission portion 77 of the photoconductor drum 11. The elastic member 99 is constituted of a coil spring that urges the support member 98 upward. The positioning member 97 facilitates a positioning operation in which the first drive force transmission portion 77 of the photoconductor drum 11 is inserted into the positioning member 97 by allowing the support member 98 to move downward because of the weight of the process cartridge 80 when the first drive force transmission portion 77 of the photoconductor drum 11 of the process cartridge 80 contacts the positioning member 97.

Figure 11:
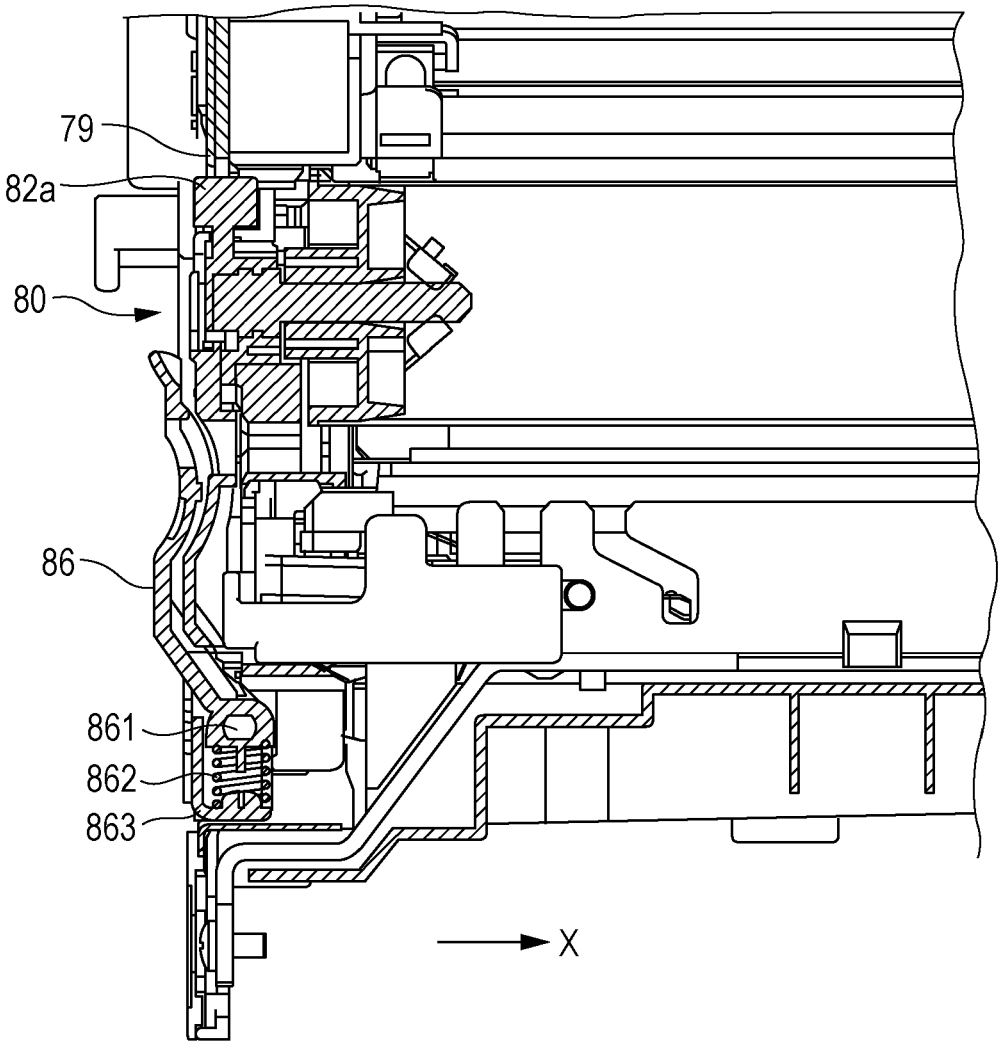
FIG. 11 is a sectional view illustrating the configuration of the particular portion of the mount portion for the process cartridges.

As illustrated in FIG. 8, meanwhile, an ascent/descent lever 86 is turnably provided at an end portion of the process cartridge 80 on the front side along the mount direction (X direction). The ascent/descent lever 86 moves the process cartridge 80 to the working position on the upper side. As illustrated in FIG. 11, the ascent/descent lever 86 is attached to the frame member 82 of the process cartridge 80 so as to be turnable about a turning shaft 861. In addition, the ascent/descent lever 86 includes an abutment portion 863 which is provided below the turning shaft 861 and to which an elastic force in the direction of moving away from the turning shaft 861 is applied via a coil spring 862.

As illustrated in FIG. 8, the ascent/descent lever 86 is turned to the front side of the process cartridge 80 before the process cartridge 80 is mounted to the prescribed operating position. After the process cartridge 80 is moved to the operating position of the cartridge support portion 91, the ascent/descent lever 86 is turned by about 90 degrees to be substantially parallel to an end surface of the process cartridge 80 on the front side as illustrated in FIG. 11. With such an operation, the ascent/descent lever 86 moves an end portion of the process cartridge 80 on the front side along the mount direction to the operating position on the upper side using the principle of leverage about the turning shaft 861. As discussed above, an end portion of the process cartridge 80 on the back side has already been moved to the operating position on the upper side. At this time, as illustrated in FIGS. 1 and 2, the photoconductor drum 11 of the process cartridge 80 has been stopped at the operating position at which the photoconductor drum 11 is in contact with the first transfer device 15 via the intermediate transfer belt 21. As illustrated in FIGS. 9 and 11, an end portion of the process cartridge 80 on the front side along the mount direction (X direction) is positioned at the operating position by causing an upper end surface 82*a* of the frame member 82 on the front side along the mount direction to abut against the lower surface of the abutment portion 79 of the image forming apparatus body 1*a*.

As illustrated in FIG. 4, the process cartridge 80 is provided with a grip portion 87 to be gripped by a hand of a user when the process cartridge 80 is mounted to and removed from the image forming apparatus body 1*a*. It is not necessary that the process cartridge 80 should include all of the image forming members such as the photoconductor drum 11 and the charging device 12, the developing device 14, and the drum cleaning device 15 disposed around the photoconductor drum 11. The process cartridge 80 may be composed of the photoconductor drum 11, the charging device 12, and the developing device 14, or may be composed of the photoconductor drum 11, the developing device 14, and so forth, among the image forming members.

As illustrated in FIG. 8, the process cartridge 80 is mounted at the prescribed operating position of the image forming apparatus body 1*a* to be supplied with a drive force and electric power from the image forming apparatus body 1*a* side.

Operation of Image Forming Apparatus

Basic image forming operation performed by the image forming apparatus 1 will be described below.

Operation for forming a full-color image by combining toner images in four colors (Y, M, C, K) using the four image preparing devices 10 (Y, M, C, K) will be described.

As illustrated in FIGS. 1 and 2, when the image forming apparatus 1 receives command information requesting image forming operation (printing), the four image preparing devices 10 (Y, M, C, K), the intermediate transfer device 20, the second transfer device 30, the fixing device 40, and so forth are started.

In each of the image preparing devices 10 (Y, M, C, K), first, the photosensitive drum 11 rotates in the direction indicated by the arrow A, and the charging device 12 charges the surface of the photosensitive drum 11 with a prescribed polarity (in the first exemplary embodiment, negative polarity) and a predefined potential. Then, the exposure device 13 radiates the surface of the photosensitive drum 11 after being charged with light emitted on the basis of a signal for an image obtained by converting information on an image input to the image forming apparatus 1 into each color component (Y, M, C, K). Thus, an electrostatic latent image for each color component with a prescribed potential difference is formed on the surface of the photosensitive drum 11.

Then, the developing device 14 (Y, M, C, K) develops the electrostatic latent image for each color component formed on the photosensitive drum 11 by supplying a toner for the corresponding color (Y, M, C, K) charged with a prescribed polarity (negative polarity) from the developing roller 141 for electrostatic adhesion. As a result of the development, the electrostatic latent images for the various color components formed on the photosensitive drums 11 are rendered manifest as toner images in the four colors (Y, M, C, K) developed using toners for the corresponding colors.

Then, when the toner image in each color formed on the photosensitive drum 11 of the image preparing device 10 (Y, M, C, K) is transported to the first transfer position, the first transfer device 15 performs a first transfer on the toner image in each color such that the toner images in the various colors are sequentially superposed on the intermediate transfer belt 21 of the intermediate transfer device 20 which rotates in the direction indicated by the arrow B.

In the image preparing devices 10 which have finished the first transfer, the drum cleaning device 16 removes, or scrapes off, attached matter to clean the surface of the photosensitive drum 11. This allows the image preparing devices 10 to be ready for the next image preparing operation.

Then, the intermediate transfer device 20 transports the toner images which have been subjected to the first transfer to the second transfer position through rotation of the intermediate transfer belt 21. Meanwhile, the paper feed device 50 feeds the prescribed recording paper 5 to the paper feed/transport path 56 in accordance with the image preparing operation. In the paper feed/transport path 56, the pair of paper transport rollers 54 that serve as resist rollers feed the recording paper 5 to the second transfer position in accordance with the transfer timing to supply the recording paper 5.

At the second transfer position, the second transfer roller 31 of the second transfer device 30 collectively performs a second transfer of the toner images on the intermediate transfer belt 21 onto the recording paper 5. In the intermediate transfer device 20 which has finished the second transfer, the belt cleaning device 27 removes attached matter such as a toner remaining on the surface of the intermediate transfer belt 21 after the second transfer.

Then, the recording paper 5, onto which the toner images have been transferred through the second transfer, is peeled from the intermediate transfer belt 21 and the second transfer roller 31, and thereafter transported to the fixing device 40 via the transport guides 57 and 58. In the fixing device 40, the recording paper 5 after being subjected to the second transfer is introduced to the contact portion between the heating rotary member 41 and the pressurizing rotary member 42 which are rotating to pass through the contact portion to perform a necessary fixation process (heating and pressurization) to fix unfixed toner images to the recording paper 5. Lastly, in the case of image forming operation in which an image is to be formed on only one surface of the recording paper 5, the recording paper 5 after being subjected to the fixation is ejected to the paper ejection portion 60 provided at the upper portion of the body 1*a*, for example, by the pair of paper ejection rollers 61.

In the case where an image is to be formed on both surfaces of the recording paper 5, meanwhile, the recording paper 5 on one surface of which an image has been formed is not ejected to the paper ejection portion 60 by the pair of paper ejection rollers 61, and the rotational direction of the pair of paper ejection rollers 61 is switched to the reverse direction while the pair of paper ejection rollers 61 hold the rear end of the recording paper 5. The recording paper 5 passes over the switching gate 62, and thereafter is transported in the reverse direction by the pair of paper ejection rollers 61 to the pair of paper transport rollers 54, with the front and back sides of the recording paper 5 reversed, via the two-sided printing transport path 63 which includes the pair of paper transport rollers 64, the transport guides 65 to 68, and so forth. The pair of paper transport rollers 54 feed the recording paper 5 to the second transfer position in accordance with the transfer timing so that an image is formed on the back surface of the recording paper 5. The recording paper 5 is ejected to the paper ejection portion 60 provided at the upper portion of the body 1*a* by the pair of paper ejection rollers 61.

As a result of the operation described above, the recording paper 5 is output with a full-color image formed thereon by combining the toner images in the four colors.

Configuration of Toner Replenishment Device

In the image forming apparatus 1 according to the first exemplary embodiment, as illustrated in FIGS. 1 and 2, the toner composing the developer 4 housed inside the developing device 14 of the image preparing device 10 (Y, M, C, K) is consumed along with the image forming operation performed in the image preparing device 10 (Y, M, C, K) for yellow (Y), magenta (M), cyan (C), and black (K) to form a toner image in the corresponding color.

Figure 12:
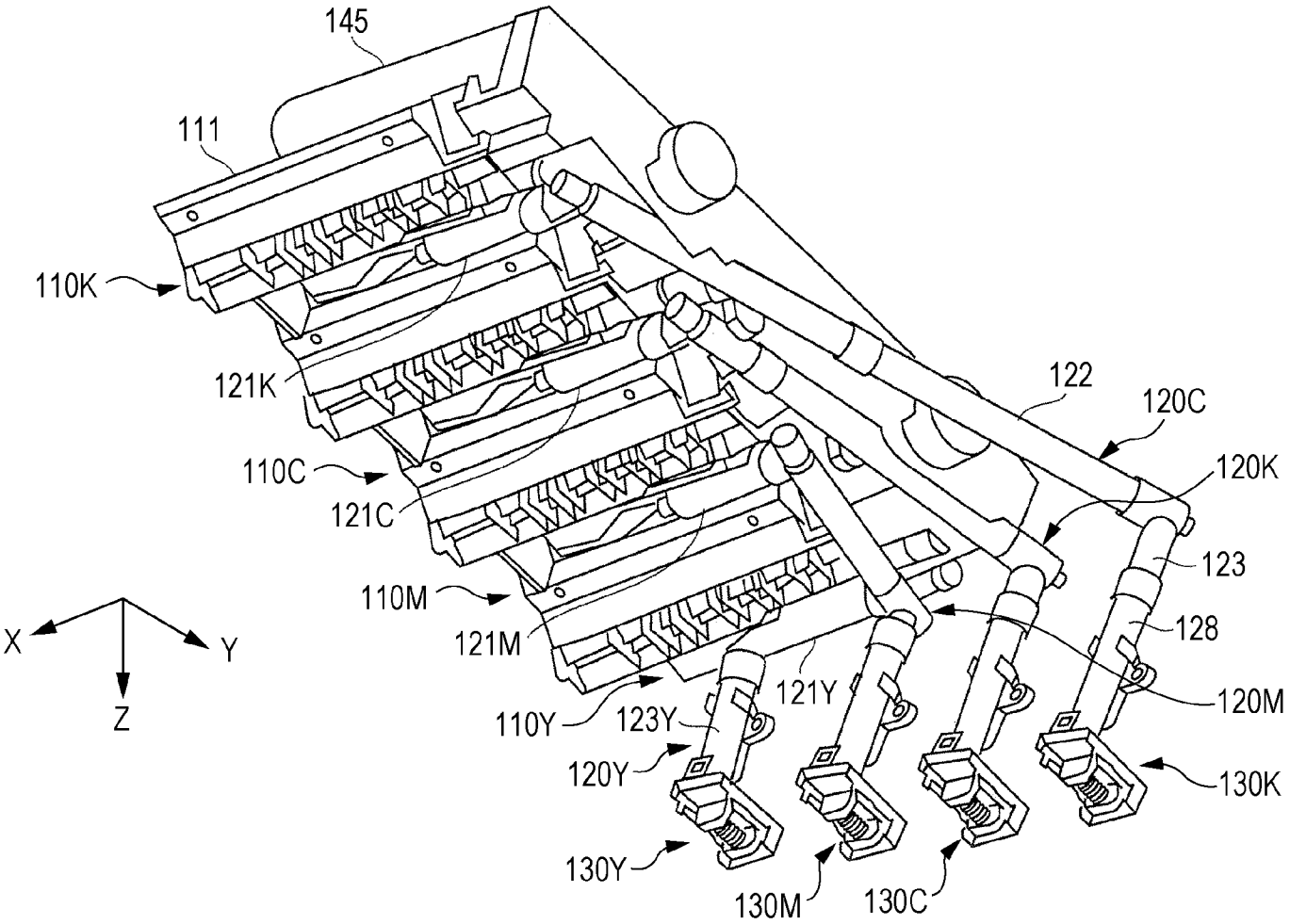
FIG. 12 is a perspective view illustrating the configuration of the developer replenishment device according to the first exemplary embodiment of the present invention.

As illustrated in FIG. 12, the image forming apparatus 1 includes a toner replenishment device 110 (Y, M, C, K) that serves as an example of a developer replenishment device that replenishes the developing device 14 of the image preparing device 10 (Y, M, C, K) for yellow (Y), magenta (M), cyan (C), and black (K) with the developer containing at least the toner for the corresponding color at a prescribed timing. The toner replenishment devices 110 (Y, M, C, K) are basically configured in the same manner as each other. In the exemplary embodiment, the developer replenishment device replenishes the developing device 14 with only the toner. However, the developer replenishment device may replenish the developing device 14 with the developer 4 containing the toner and the carrier. In this event, the toner concentration of the developer 4 supplied to the developing device 14 is set to be higher than that of the developer 4 in the developing device 14 as necessary.

The toner replenishment device 110 includes a mount member 111, a toner transport member 120, and a holder member 130. The toner cartridge 145 which serves as an example of a developer housing container is mounted to the mount member 111. The toner transport member 120 serves as an example of a developer transport member that transports the toner from the toner cartridge 145 mounted to the mount member 111 to the developing device 14. The holder member 130 serves as an example of a joint member attached to an end portion of the toner transport member 120 on the developing device 14 side so as to be relatively displaceable with respect to the toner transport member 120 to be allowed to move in the transport direction (in the drawing, Z direction) of the toner and the direction (in the drawing, Y direction) that crosses the transport direction of the toner, by way of example, to be joined to the developing device 14 so as to be able to replenish the developing device 14 with the toner.

As illustrated in FIG. 12, the toner transport member 120 includes a first toner transport portion 121, a second toner transport portion 122, and a third toner transport portion 123. The first toner transport portion 121 transports the toner to the lower end portion of the mount member 111 along the longitudinal direction of the toner cartridge 145. The second toner transport portion 122 transports the toner from one end portion of the first toner transport portion 121 to a location above a position corresponding to an end portion of the developing device 14 of the corresponding image preparing device 10 along the longitudinal direction (axial direction). The third toner transport portion 123 transports the toner from the distal end of the second toner transport portion 122 toward the developing device 14 downward along the vertical direction (Z direction). The toner transport member 120 corresponding to the yellow color does not include the second toner transport portion 122 because of the arrangement relationship of the yellow developing device 14Y, and is composed of the first toner transport portion 121Y and the third toner transport portion 123Y. In addition, the second and third toner transport portions 122 and 123 are set to have different lengths because of the arrangement relationship between the toner cartridge 145 and the developing device 14 of the process cartridge 80 for the corresponding color. The second and third toner transport portions 122M and 123M corresponding to the magenta color are the shortest, and the second and third toner transport portions 122C and 123C corresponding to the cyan color and the second and third toner transport portions 122K and 123K corresponding to the black color are sequentially longer.

Figure 13:
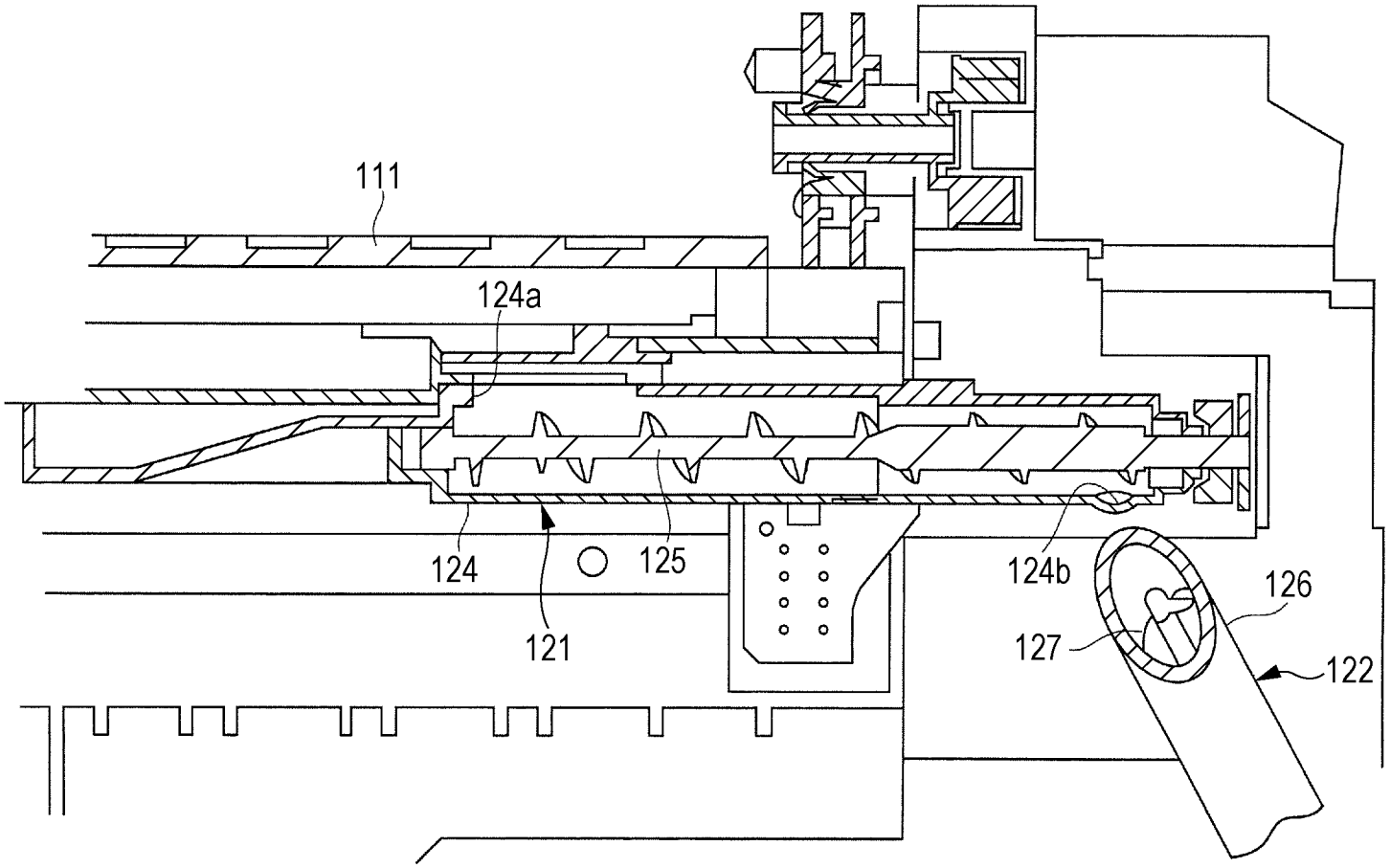
FIG. 13 is a sectional view illustrating the configuration of the developer replenishment device according to the first exemplary embodiment of the present invention.

As illustrated in FIG. 13, the first toner transport portion 121 includes a first toner transport path forming member 124 and a first agitation/transport member 125. The first toner transport path forming member 124 is formed in a cylindrical shape. The first agitation/transport member 125 is constituted of a screw auger or the like rotatably disposed inside the first toner transport path forming member 124. The first toner transport path forming member 124 includes a toner inlet port 124*a* that opens at a position corresponding to a toner supply port (not illustrated) of the toner cartridge 145. The first toner transport path forming member 124 also includes an opening portion 124*b* provided at the distal end portion along the transport direction of the first agitation/transport member 125 to allow the toner to fall down into the second toner transport portion 122.

As illustrated in FIG. 13, meanwhile, the second toner transport portion 122 includes a second toner transport path forming member 126 and a second agitation/transport member 127. The second toner transport path forming member 126 is formed in a cylindrical shape, and transports the toner. The second agitation/transport member 127 is constituted of a screw auger or the like rotatably disposed inside the second toner transport path forming member 126. The second toner transport path forming member 126 includes an opening portion (not illustrated) provided at the distal end portion along the transport direction of the second agitation/transport member 127 to allow the toner to fall down into the third toner transport portion 123.

Figure 14:
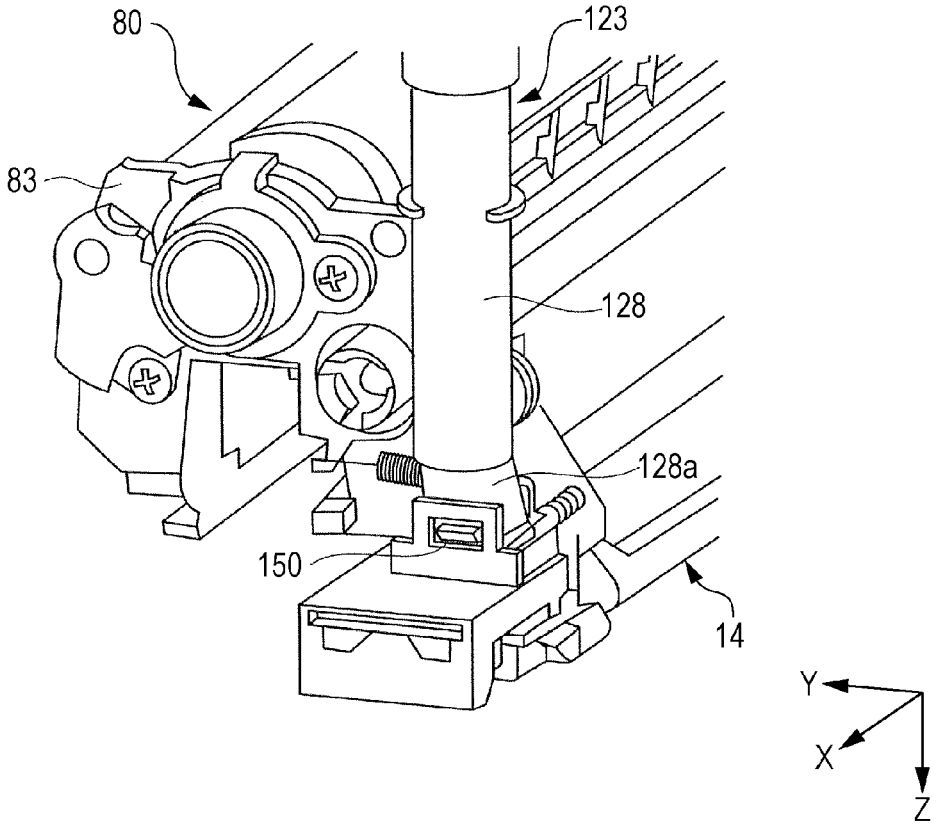
FIG. 14 is a perspective view illustrating the configuration of a particular portion of the developer replenishment device according to the first exemplary embodiment of the present invention.
Figure 18:
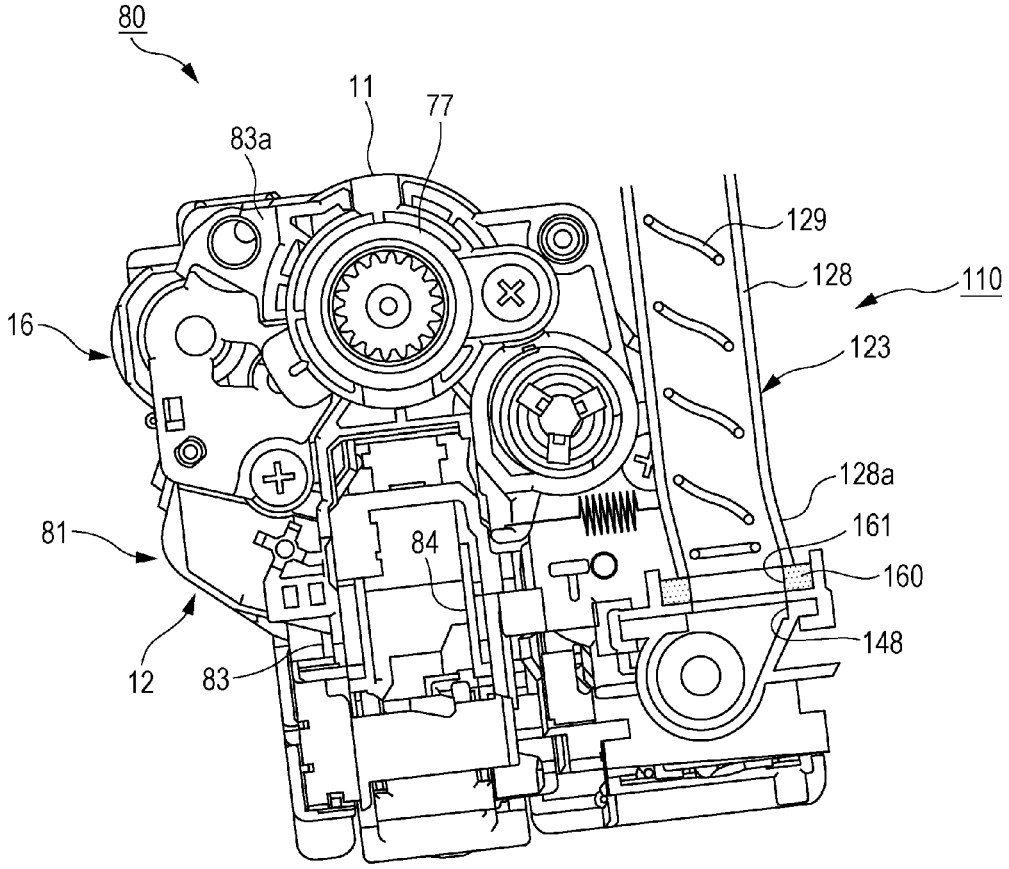
FIG. 18 is a partially cutaway back view illustrating the configuration of the particular portion of the developer replenishment device according to the first exemplary embodiment of the present invention.

As illustrated in FIGS. 14 and 18, meanwhile, the third toner transport portion 123 includes a third toner transport path forming member 128 and a transport member 129. The third toner transport path forming member 128 is formed in a cylindrical shape, and transports the toner. The transport member 129 is constituted of a spirally formed metal wire rod such as an agitator disposed inside the third toner transport path forming member 128 so as to be movable up and down. The third toner transport path forming member 128 is disposed along substantially the vertical direction with respect to the image forming apparatus body 1*a*. The upper end portion of the transport member 129 is coupled to a crank portion (not illustrated) provided at the distal end of the second agitation/transport member 127. The transport member 129 is driven so as to reciprocally move along the up-down direction along with rotating operation of the crank portion of the second agitation/transport member 127 to allow the toner introduced into the third toner transport path forming member 128 to fall down along substantially the vertical direction.

As illustrated in FIG. 14, a lower end portion 128*a* of the third toner transport path forming member 128 is disposed at a position corresponding to a location above an distal end portion of the developing device 14 of the process cartridge 80, which is mounted at the operating position, along the longitudinal direction (X direction). As illustrated in FIG. 10, an intermediate portion of the third toner transport path forming member 128 is fixed by a fixer 128*b* screwed to a side frame 1*b* in the image forming apparatus body 1*a*.

Figure 15:
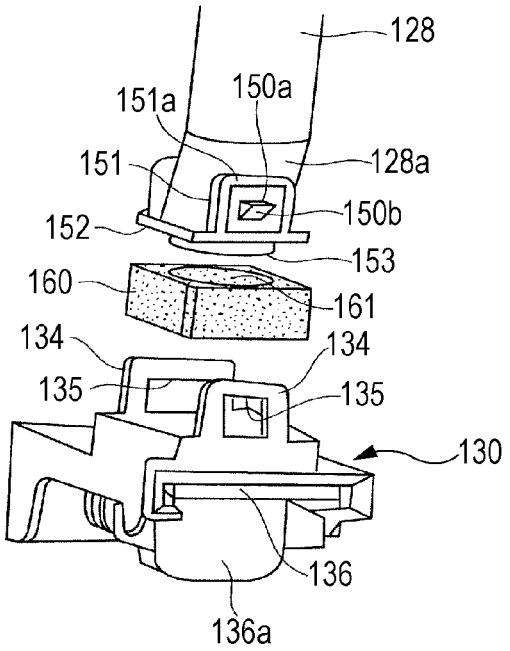
FIG. 15 is an exploded perspective view illustrating the particular portion of the developer replenishment device according to the first exemplary embodiment of the present invention.

As illustrated in FIGS. 14 and 15, a protruding portion 150 is integrally provided at the lower end portion of the third toner transport path forming member 128. The protruding portion 150 constitutes one of engagement portions (snap-fit portions) for attachment of the holder member 130 to both side surfaces of the process cartridge 80 along the mount direction (X direction) so as to be displaceable in the transport direction (Z direction) of the toner and the direction (Y direction) that crosses the transport direction of the toner. The protruding portion 150 is formed in a substantially right triangle shape in side view from an upper end surface 150*a* and an inclined surface 150*b*. The upper end surface 150*a* projects laterally and substantially horizontally from a side surface of the third toner transport path forming member 128. The inclined surface 150*b* is formed to be inclined from the distal end of the upper end surface 150*a* toward the side surface of the third toner transport path forming member 128. In addition, a frame portion 151 in a rectangular shape in side view is provided at the outer periphery of the protruding portion 150 so as to surround the outer periphery of the protruding portion 150.

In addition, a flange portion 152 having a square shape in plan is provided integrally with the frame portion 151 at the outer periphery of the lower end portion of the third toner transport path forming member 128. A side surface 151*a* of the frame portion 151 and the flange portion 152 forms a flat surface that guides an engagement portion (snap-fit portion) on the holder member 130 side to be discussed later. Further, a joint portion 153 formed in a short cylindrical shape to extend downward is provided at the lower end of the third toner transport path forming member 128.

As illustrated in FIG. 15, an elastic member 160 is interposed between the third toner transport path forming member 128 and the holder member 130. The elastic member 160 is formed in the shape of a rectangular parallelepiped having a rectangular shape in plan from an elastic material such as foamed polyurethane or compression-molded foamed polyurethane. The elastic member 160 has a prescribed thickness (e.g. about 4 to 5 mm). In addition, a guide hole 161 having a circular shape in plan is formed to penetrate the elastic member 160. The guide hole 161 guides the toner from the third toner transport path forming member 128 toward the holder member 130.

Figure 16A:
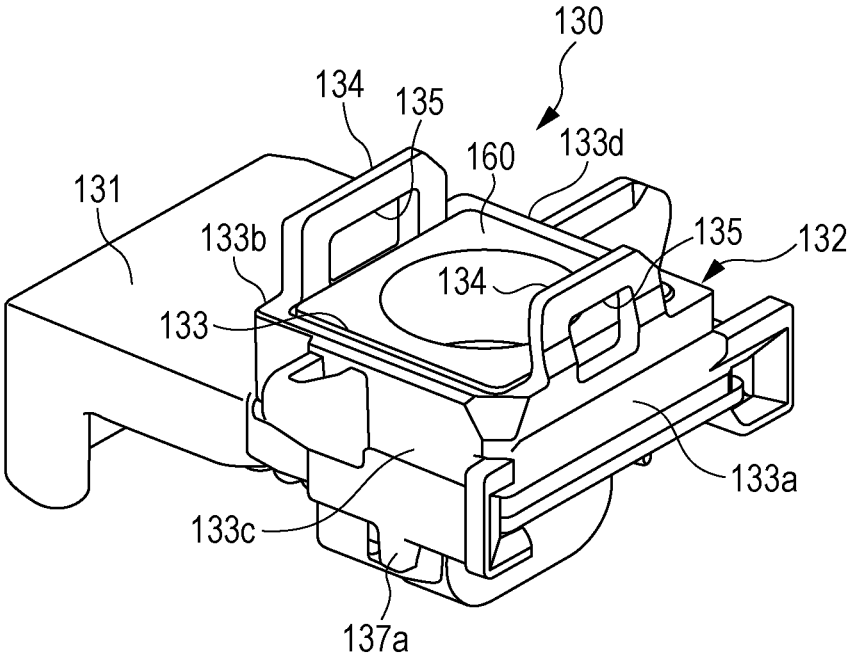
FIGS. 16A and 16B are each a perspective view illustrating a holder member.
Figure 16B:
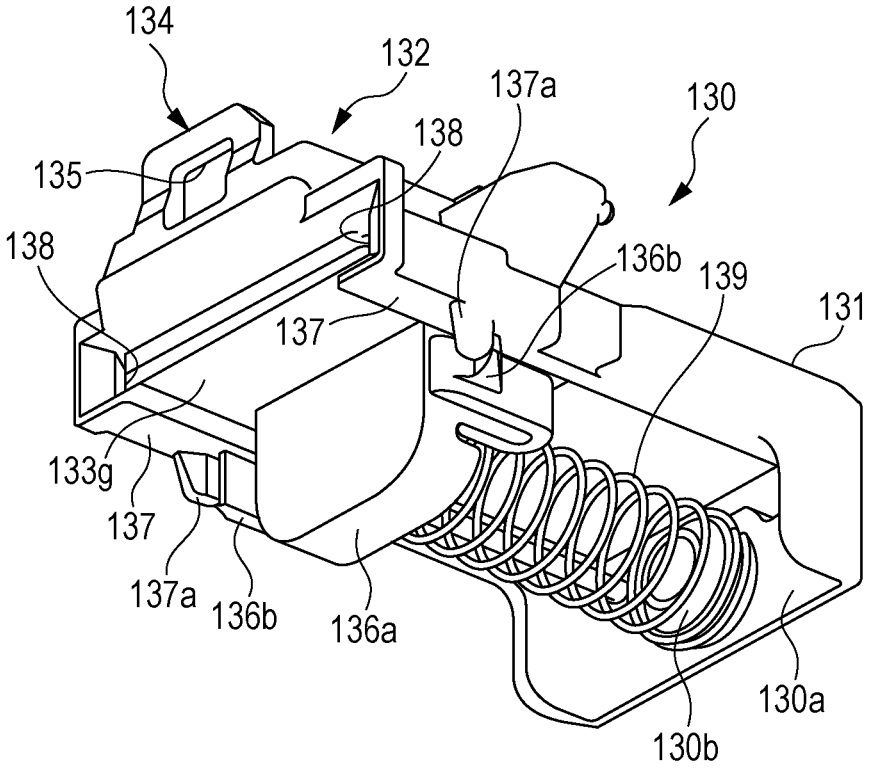
Figure 17A:
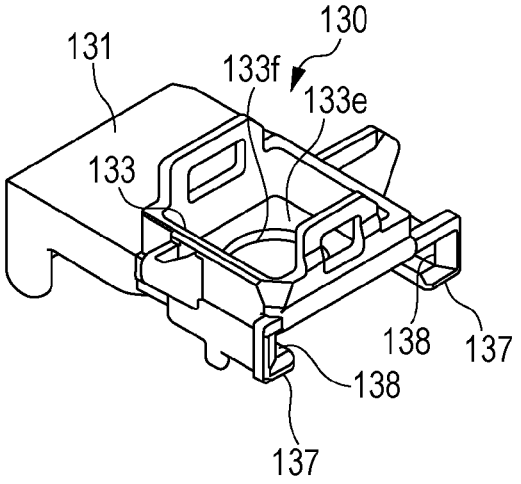
FIGS. 17A to 17C are an upper perspective view, a lower perspective view, and a plan view, respectively, illustrating the holder member.
Figure 17B:
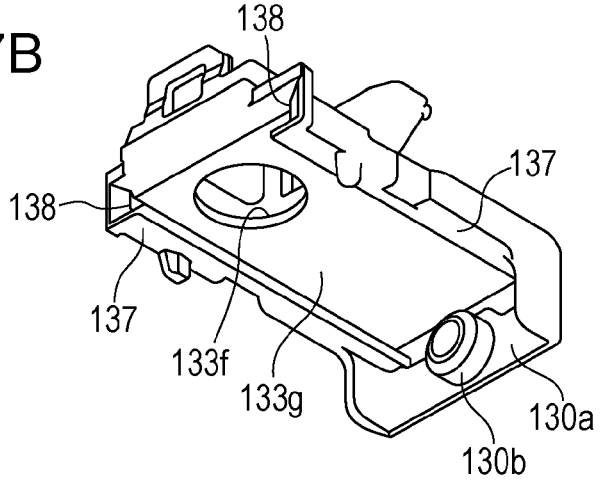
Figure 17C:
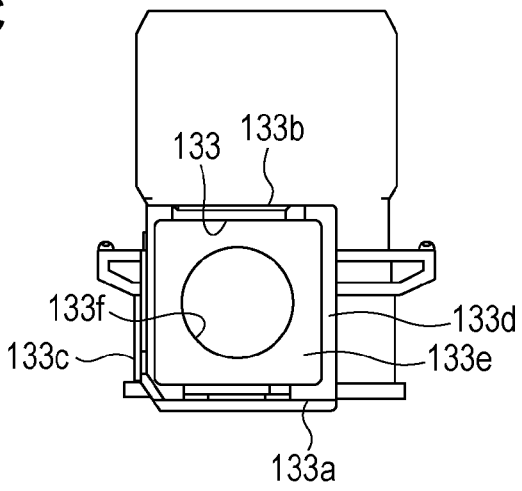

As illustrated in FIGS. 15, 16, and 17, the holder member 130 is integrally formed in a rectangular shape in plan from a synthetic resin. A coupling portion 132 is provided at one end portion, along the longitudinal direction, of an upper surface 131 of the holder member 130. The coupling portion 132 is coupled to the third toner transport path forming member 128 while housing the elastic member 160. The coupling portion 132 includes a housing portion 133 constituted of a recessed portion in a square shape in plan that houses the elastic member 160. The housing portion 133 is composed of front and rear side walls 133*a* and 133*b*, left and right side walls 133*c* and 133*d*, and a bottom wall 133*e* provided on the upper end surface 131 of the holder member 130. The side walls 133*a* and 133*b* are provided on both sides along the mount direction of the process cartridge 80. The side walls 133*c* and 133*d* are provided on both sides along the direction (Y direction) that crosses the mount direction (X direction) of the process cartridge 80. The bottom wall 133*e* is provided at the bottom portion of the housing portion 133.

In addition, the holder member 130 includes a second engagement portion (snap-fit portion) 134 formed integrally with the upper end portion of the front and rear side walls 133*a* and 133*b* of the housing portion 133 to extend toward the third toner transport path forming member 128. The second engagement portion 134 is formed in the shape of a flat plate having therein a recessed portion (opening portion) 135 in a rectangular shape in side view that relatively engages with the protruding portion 150 which serves as a first engagement portion. The opening portion 135 of the second engagement portion 134 is set to be larger than the side surface of the protruding portion 150 such that a gap is formed between the protruding portion 150 and the opening portion 135. Therefore, the second engagement portion 134 is displaceably attached such that the holder member 130 allows movement along the transport direction (Z direction) of the toner and the direction (Y direction) that crosses the transport direction of the toner when the second engagement portion 134 relatively engages with the protruding portion 150 of the third toner transport path forming member 128. The second engagement portion 134 is formed such that the upper end portion is thinner than the lower end portion to be easily elastically deformed when the second engagement portion 134 engages with the protruding portion 150 of the third toner transport path forming member 128.

As illustrated in FIG. 17, meanwhile, a supply port 133*f* in a circular shape corresponding to the guide hole 161 of the elastic member 160 opens in the bottom wall 133*e* of the housing portion 133 of the holder member 130. In addition, a shutter member 136 that opens and closes the supply port 133*f* is slidably mounted to a lower end surface 133*g* of the holder member 130. A holding portion 137 in the shape of a narrow flat plate is provided at both end portions, in the direction that crosses the longitudinal direction, of the lower end surface 133*g* of the holder member 130. The holding portion 137 is formed to extend inward in parallel with the lower end surface 133*g*. The shutter member 136 is slidably held by a recessed portion 138 formed by the lower end surface 133*g* of the holder member 130 and the holding portion 137. As illustrated in FIG. 16, further, a coil spring 139 is disposed on the lower end surface 133*g* of the holder member 130. The coil spring 139 is compressed to urge the shutter member 136 in the direction of closing the supply port 133*f*. The coil spring 139 is disposed to be interposed between a projected portion 130*b* in a cylindrical shape and a receiving portion 136*a*. The projected portion 130*b* is provided on a side wall 130*a* that hangs down from an end portion of the holder member 130 opposite to the housing portion 133. The receiving portion 136*a* hangs down from the lower surface of the shutter member 136. In addition, the shutter member 136 is stopped while blocking the supply port 133*f* when an arm portion 136*b* provided to project from both side surfaces of the shutter member 136 abuts against a stopper portion 137*a* provided on the lower surface of the holding portion 137 of the holder member 130.

Figure 19:
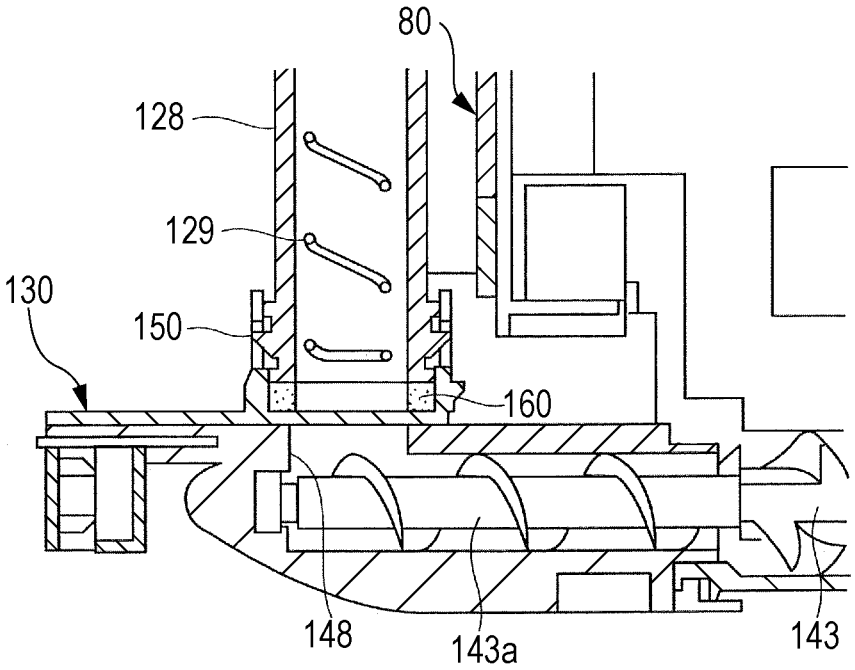
FIG. 19 is a sectional view illustrating the configuration of the particular portion of the developer replenishment device according to the first exemplary embodiment of the present invention.
Figure 20A:
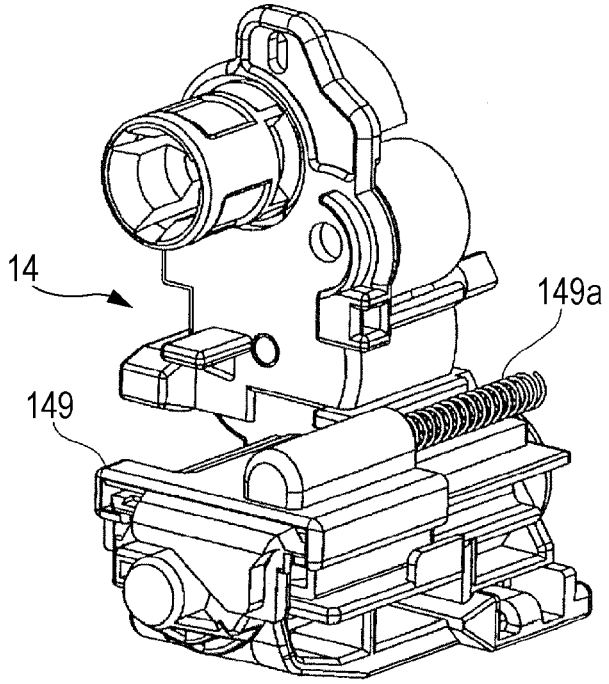
FIGS. 20A and 20B each illustrate the configuration of a particular portion of a developing device to which the developer replenishment device according to the first exemplary embodiment of the present invention is applied.
Figure 20B:
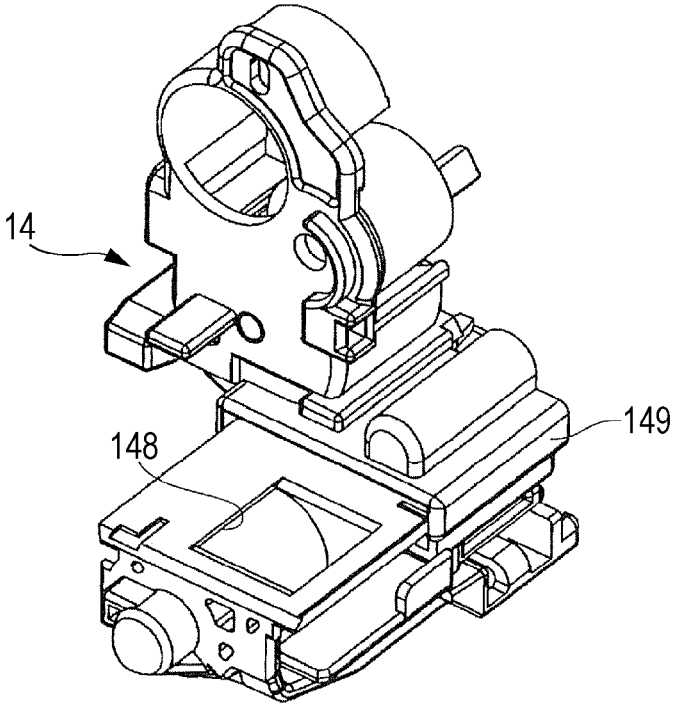

As illustrated in FIGS. 18 to 20, in addition, the developing device 14 provided to the process cartridge 80 includes a toner replenishment port 148 provided in the upper end surface of the process cartridge 80 at the distal end portion along the mount direction (X direction) to replenish the inside of the housing 140 of the developing device 14 with the toner. A shutter member 149 that opens and closes the toner replenishment port 148 is mounted to the toner replenishment port 148 of the developing device 14. The shutter member 149 is slidably attached to both end portions of a replenishment portion in which the toner replenishment port 148 is formed. In addition, the shutter member 149 is urged by a coil spring 149*a* to block the toner replenishment port 148. As illustrated in FIG. 20, the shutter member 149 is formed to be generally identical in shape to the holder member 130, and both end portions of the replenishment portion in which the toner replenishment port 148 is formed are formed to be substantially identical in shape to the shutter member 136. As a result, when the process cartridge 80 is mounted, the holder member 130 pushes the shutter member 149 so as to open the toner replenishment port 148, and pushes the shutter member 136 such that the toner replenishment port 148 is opened by both end portions of the replenishment portion of the developing device 14, which establishes a state in which the toner may be supplied from the supply port 133*f* of the holder member 130 to the toner replenishment port 148 of the developing device 14.

Figure 21A:
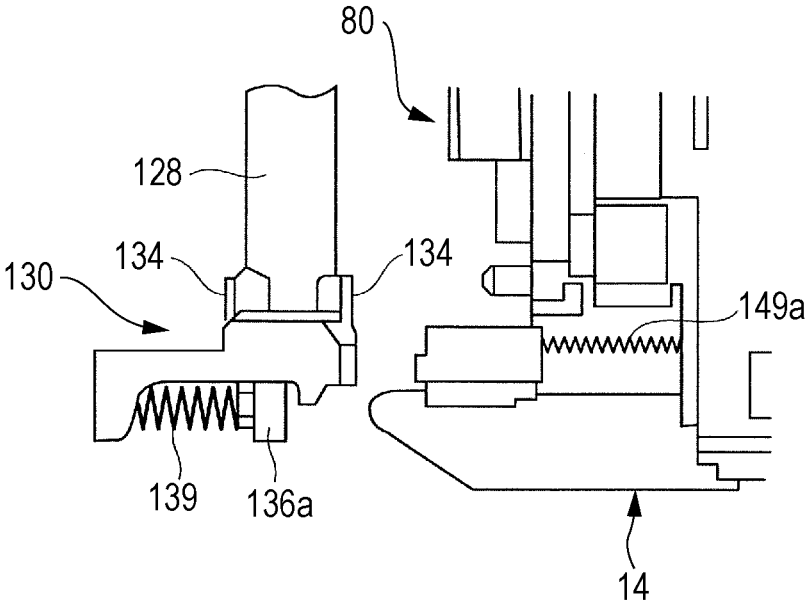
FIGS. 21A and 21B each illustrate operation of the developer replenishment device according to the first exemplary embodiment of the present invention.
Figure 21B:
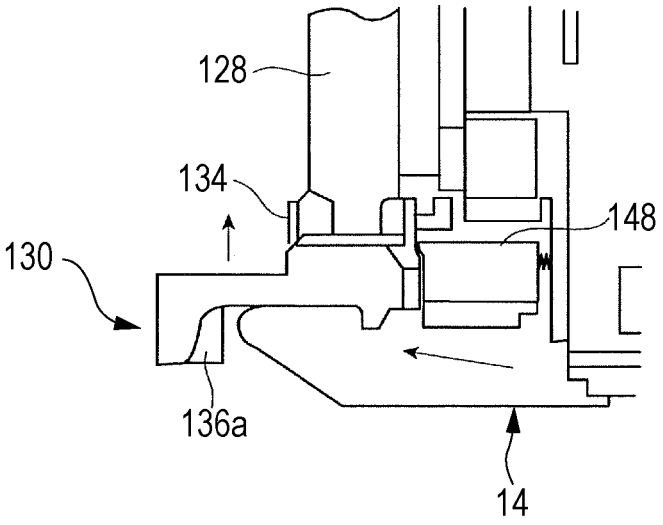

In the developing device 14 of the process cartridge 80, as illustrated in FIG. 21, the shutter member 149 which blocks the toner replenishment port 148 contacts the holder member 130 of the toner replenishment device 110 when the process cartridge 80 is mounted to the image forming apparatus body 1*a*. After that, along with operation of mounting the process cartridge 80 to the image forming apparatus body 1*a*, the shutter member 149 of the developing device 14 is pushed by the holder member 130 to open the toner replenishment port 148, and the shutter member 136 of the holder member 130 is pushed by a flange portion of the developing device 14 to open the supply port 133*f*. As a result, as illustrated in FIGS. 18 to 20, the toner may be supplied from the third toner transport member 128 of the toner replenishment device 110 to the toner replenishment port 148 of the developing device 14 via the holder member 130. The shutter member 149 of the developing device 14 is retained by a retention member (not illustrated) so as to be stopped in the state of blocking the toner replenishment port 148.

In addition, as illustrated in FIG. 8, when the process cartridge 80 is mounted at the operating position of the image forming apparatus body 1*a*, the process cartridge 80 is moved to the operating position on the upper side when the first drive force transmission portion 77 of the process cartridge 80 is inserted into the positioning member 97 on the image forming apparatus body 1*a* side. Along with upward movement of the process cartridge 80, an end portion of the developing device 14 is moved upward, and the elastic member 160 housed in the holder member 130 is compressed, which suppresses occurrence of a gap between the third toner transport portion 123 on the image forming apparatus body 1*a* side and the holder member 130.

Operation of Toner Replenishment Device

In the first exemplary embodiment, as illustrated in FIG. 12, the toner housed in the toner cartridge 145 is supplied to the developing device 14 of the process cartridge 80 (Y, M, C, K) for the corresponding color by the toner replenishment device 110 (Y, M, C, K).

For further description, as illustrated in FIG. 12, the toner supplied from the toner cartridge 145 is transported to the upper end portion of the third toner transport portion 123 via the first and second toner transport portions 121 and 122 of the toner replenishment device 110. The toner transported to the upper end portion of the third toner transport portion 123 is transported to the distal end portion (lower end portion) of the third toner transport path forming member 128 by the transport member 129, which is driven so as to be movable along the up-down direction, through the inside of the third toner transport path forming member 128, which is disposed along substantially the vertical direction with respect to the image forming apparatus body 1*a*, so as to fall downward along the vertical direction. As illustrated in FIGS. 14 and 15, the holder member 130 is attached to the distal end portion of the third toner transport path forming member 128 so as to be displaceable in the transport direction (Z direction) of the toner and the direction (Y direction) that crosses the transport direction of the toner via a snap-fit portion composed of the protruding portion 150 and the second engagement portion 134.

In this event, there may be a tolerance in position of attachment of the third toner transport path forming member 128 to the image forming apparatus body 1*a* within a range allowed in advance with respect to the normal attachment position due to an error in manufacture of the third toner transport path forming member 128, an error in attachment position (see FIG. 10), and so forth. There may also be a tolerance in position of mounting of the process cartridge 80 to the image forming apparatus body 1*a* with respect to the normal mounting position due to an error in manufacture of members composing the process cartridge 80, misregistration during positioning, and so forth.

In the first exemplary embodiment, as illustrated in FIGS. 14 and 15, the holder member 130 is attached to the distal end portion of the third toner transport path forming member 128 so as to be displaceable along the transport direction (Z direction) of the toner and the direction (Y direction) that crosses the transport direction of the toner. Therefore, even in the case where there is relative misregistration between the distal end portion 128*a* of the third toner transport path forming member 128 of the toner replenishment device 110 and the developing device 14 of the process cartridge 80, the holder member 130 is displaced with respect to the third toner transport path forming member 128 along the transport direction (Z direction) of the toner and the direction (Y direction) of being brought into and out of contact with the photoconductor drum 11, which absorbs relative misregistration between the third toner transport path forming member 128 and the developing device 14 of the process cartridge 80. In this event, misregistration along the transport direction of the toner is absorbed as the elastic member 160 interposed between the third toner transport path forming member 128 and the holder member 130 is elastically deformed along the thickness (height) direction. Meanwhile, misregistration along the direction of being brought into and out of contact with the photoconductor drum 11 is absorbed as the elastic member 160 is elastically deformed along the radial direction of the guide hole 161.

As illustrated in FIG. 19, further, the toner supplied into the developing device 14 is transported to the second agitation/transport member 143 via the transport member 143*a* which is formed integrally with an end portion of the second agitation/transport member 143 along the axial direction. As illustrated in FIG. 3, the toner transported to the second agitation/transport member 143 is transported along the axial direction of the second agitation/transport member 143 while being agitated with the developer 4 housed inside the housing 140 of the developing device 14 by the second agitation/transport member 143 which is rotationally driven. The developer 4 transported to an end portion of the second agitation/transport member 143 along the axial direction is delivered to the first agitation/transport member 142, and supplied to the developing roller 141 while being agitated with the developer 4 housed inside the housing 140 of the developing device 14 while being transported along the axial direction of the first agitation/transport member 142 to be used to develop the electrostatic latent image formed on the surface of the photoconductor drum 11.

As illustrated in FIG. 11, in the case where the process cartridge 80 is removed from the image forming apparatus body 1*a*, meanwhile, the ascent/descent lever 86, which is provided at an end portion of the process cartridge 80 on the front side along the mount direction, is turned to the front side to descend an end portion of the process cartridge 80 on the front side along the mount direction. After that, as illustrated in FIG. 8, the process cartridge 80 is drawn out toward the front side along the mount direction (X direction) with respect to the cartridge support portion 91 of the image forming apparatus body 1*a* to take the process cartridge 80 out of the image forming apparatus body 1*a*. In this event, an end portion of the process cartridge 80 on the back side along the mount direction (X direction) is detached from the positioning member 97, which is provided at an end portion of the image forming apparatus body 1*a* on the back side, to move downward along with operation of drawing the process cartridge 80 out of the operating position of the image forming apparatus body 1*a*, which moves the photoconductor drum 11 of the process cartridge 80 away from the intermediate transfer belt 21.

Along with operation of moving the process cartridge 80 toward the front side along the mount direction (X direction) with respect to the image forming apparatus body 1*a*, the shutter member 149 of the developing device 14 moves away from the holder member 130 of the toner replenishment device 110. As illustrated in FIG. 21A, the toner replenishment port 148 of the developing device 14 is blocked by the shutter member 149, and the supply port 133*f* of the holder member 130 is blocked by the shutter member 136.

Second Exemplary Embodiment

Figure 22:
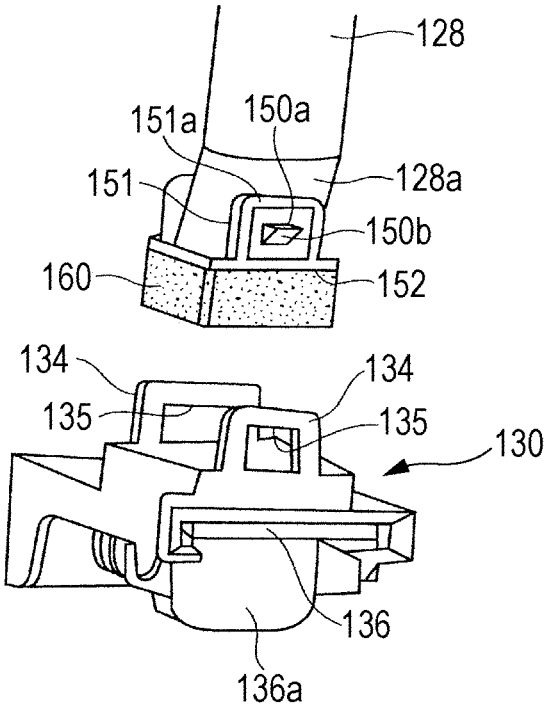
FIG. 22 is an exploded perspective view illustrating a particular portion of a developer replenishment device according to a second exemplary embodiment of the present invention.

FIG. 22 illustrates the configuration of a developer replenishment device according to a second exemplary embodiment of the present invention.

In the second exemplary embodiment, the elastic member 160 is not housed in the holder member 130, but bonded to the flange portion 152 provided integrally with the lower end surface of the third toner transport path forming member 128 via a double-sided tape (not illustrated). The elastic member 160 bonded to the flange portion 152 of the third toner transport path forming member 128 is housed in the holder member 130.

In the exemplary embodiments described above, the third toner transport path forming member 128 is disposed above the developing device 14 in the vertical direction. As a matter of course, however, the third toner transport path forming member 128 may be disposed in a horizontal direction with respect to the developing device 14.

In the exemplary embodiments described above, the third toner transport path forming member is provided with a protruding portion that serves as an engagement portion, and the holder member is provided with an opening portion that serves as an engagement portion. However, the third toner transport path forming member may be provided with an opening portion, and the holder member may be provided with a protruding portion.

In the exemplary embodiments described above, further, a protruding portion and an opening portion are each used as the engagement portion. However, the engagement portion may be any unit attached to an end portion of the developer transport member on the developing device side so as to be displaceable in the transport direction of the developer and the direction that crosses the transport direction of the developer, and may be composed of a projecting guide member and a guide groove or the like that guides the guide member.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer replenishment device as part of an image forming apparatus, the developer replenishment device comprising:

a developer transport member that transports a developer to a developing device which is removably mounted to the image forming apparatus;

a joint member attached to an end portion of the developer transport member on a side of the developing device so as to be relatively displaceable with respect to the developer transport member to be joined to the developing device so that developer moves through the joint member in a transport direction to the developing device, wherein the joint member includes a shutter member which slides by pushing by the developing device along with operation of mounting the developing device to the image forming apparatus; and an elastic member interposed between the developer transport member and the joint member so that the developer transport member is allowed to move relative to the joint member in a direction that crosses the transport direction of the developer, the elastic member including a guide hole that guides the developer from the developer transport member to the joint member, wherein the joint member is displaced toward the developer transport member together with the developing device so that the elastic member is compressed along with operation of mounting the developing device to the image forming apparatus.

2. The developer replenishment device according to claim 1, wherein the elastic member is housed in a recessed portion provided in the joint member.

3. The developer replenishment device according to claim 1, wherein the elastic member is fixed to an end surface of the developer transport member on a side of the developing device.

4. The developer replenishment device according to claim 1, wherein the developer transport member and the joint member are coupled to each other via a projected portion and a recessed portion relatively coupled to each other so as to allow movement in a transport direction of the developer and a direction that crosses the transport direction of the developer.

5. An image forming apparatus comprising:

an image holding element that holds an electrostatic latent image on a surface thereof;

a developing unit that develops the electrostatic latent image held on the surface of the image holding element using a developer; and a developer replenishment unit that replenishes the developing unit with the developer, wherein the developer replenishment device according to claim 1 is used as the developer replenishment unit.

6. The image forming apparatus according to claim 5, wherein the developing unit is provided so as to be swingable about a swing fulcrum in a direction of being brought into and out of contact with the image holding element.

7. The image forming apparatus according to claim 5, wherein the image holding element and the developing unit compose an image forming unit removably attached to an image forming apparatus body.

8. The developer replenishment device according to claim 4, wherein the developer transport member and the joint member are coupled to each other on both sides of along a mount direction of the developing device and not coupled on both sides along a direction crossing the mount direction.

9. The developer replenishment device according to claim 1, wherein the joint member comprises a recessed portion that removably couples to a projected portion of the developer transport member to allow the joint member to be removably attached to the developer transport member upon actuation of the projected portion.

10. The developer replenishment device according to claim 1, wherein the joint member is removably attachable to the developer transport member and the joint member, when attached to the developer transport member and the elastic member is disposed between the joint member and the developer transport member, is also removably attachable to the developing device.

* * * * *